US006508395B2

(12) United States Patent
McLeod

(10) Patent No.: US 6,508,395 B2
(45) Date of Patent: Jan. 21, 2003

(54) STACKABLE SHIPPING CONTAINER

(75) Inventor: Michael B. McLeod, Romeoville, IL (US)

(73) Assignee: Stone Container Corporation, Chicago, IL (US)

( * ) Notice: Subject to any disclaimer, the term of this patent is extended or adjusted under 35 U.S.C. 154(b) by 0 days.

(21) Appl. No.: 10/086,053

(22) Filed: Feb. 28, 2002

(65) Prior Publication Data

US 2002/0125308 A1 Sep. 12, 2002

Related U.S. Application Data

(63) Continuation-in-part of application No. 09/804,290, filed on Mar. 12, 2001, now abandoned.

(51) Int. Cl.[7] ..... B65D 5/20; B65D 21/032

(52) U.S. Cl. ..... 229/174; 229/168; 229/918; 229/919

(58) Field of Search ..... 229/168, 174, 229/191, 915, 918, 919; 206/509, 511, 512

(56) References Cited

U.S. PATENT DOCUMENTS

| | | | |
|---|---|---|---|
| 2,074,090 | A | 3/1937 | Loth |
| 2,295,141 | A | 9/1942 | Van Wingen |
| 2,885,137 | A | 5/1959 | Guyer |
| 2,934,250 | A | 4/1960 | Stotz |
| 2,986,320 | A | 5/1961 | Nicholls et al. |
| 3,055,573 | A | 9/1962 | Carter |
| 3,114,493 | A | 12/1963 | Dunkin |
| 3,118,591 | A | 1/1964 | Allard et al. |
| 3,220,633 | A | 11/1965 | Swane |
| 3,252,648 | A | 5/1966 | Johnson |
| 3,375,967 | A | 4/1968 | Robinson |
| 3,533,547 | A | 10/1970 | Houston |
| 3,820,706 | A | 6/1974 | Gibson et al. |
| 3,917,156 | A | 11/1975 | Baudet |
| 3,929,273 | A | 12/1975 | Swanson |

(List continued on next page.)

FOREIGN PATENT DOCUMENTS

| | | | |
|---|---|---|---|
| AU | A-61361/90 | 3/1991 | ..... B65D/5/22 |
| AU | A-13040/92 | 11/1992 | ..... B65D/5/22 |
| DE | 34 23 259 A1 | 1/1986 | ..... B65D/5/20 |
| DE | 40 17 416 A1 | 12/1990 | ..... B65D/21/02 |
| DE | 41 02 166 A1 | 7/1992 | ..... B65D/85/34 |
| DE | 35 30 350 C2 | 8/1992 | ..... B65D/6/04 |
| DE | 35 40 005 C2 | 11/1992 | ..... B65D/21/00 |
| EP | 0 444 044 A1 | 8/1991 | ..... B65D/5/22 |
| EP | 0 326 451 B1 | 3/1993 | ..... B65D/5/00 |
| EP | 0 567 425 A1 | 10/1993 | ..... B65D/5/00 |
| FR | 1 232 518 | 10/1960 | |
| FR | 2 261 943 | 9/1975 | ..... B65D/85/34 |
| FR | 2 306 888 | 11/1976 | ..... B65D/5/22 |
| FR | 2 539 386 | 7/1984 | ..... B65D/5/22 |

(List continued on next page.)

OTHER PUBLICATIONS

"Innovations in Product Boxes Bring Customers to Corrugated" Jim Curley; Board Converting News; Avon–By–The–Sea, New Jersey, US: Mar. 19, 1999; vol. 15, No. 13; pp. 1, 20 and 22.

Graphics presentation entitled "Corrugated Common Footprint for Product Packaging," Kroger, Sep. 13, 2000.

*Primary Examiner*—Gary E. Elkins
(74) *Attorney, Agent, or Firm*—Dick and Harris

(57) ABSTRACT

A stackable shipping container for shipping articles such as produce, which is open-topped. The shipping container is preferably provided with stacking indexing tabs configured to be received by corresponding slots in the bottom of a like container stacked atop a first such container. Inwardly inclined diagonal corner gussets are provided for providing support of the bottom of a container stacked above one such container, while increasing available container volume.

22 Claims, 19 Drawing Sheets

U.S. PATENT DOCUMENTS

| | | | | |
|---|---|---|---|---|
| 4,053,098 | A | 10/1977 | Baptist | |
| 4,082,215 | A | 4/1978 | Eichenauer | |
| 4,134,533 | A | 1/1979 | Heavner | |
| 4,151,948 | A | 5/1979 | de la Fuente, Jr. | |
| 4,180,200 | A | 12/1979 | Wilkinson, Sr. | |
| 4,196,843 | A | 4/1980 | Garmon | |
| 4,613,045 | A | 9/1986 | Watson | |
| 4,770,339 | A | 9/1988 | Weimer | 229/143 |
| 4,905,834 | A | 3/1990 | Mur Gimeno et al. | 206/512 |
| 4,923,113 | A | 5/1990 | Guijarro | 229/125.27 |
| 4,932,530 | A | 6/1990 | von Zuben et al. | |
| 5,028,000 | A | 7/1991 | Chabot et al. | 229/143 |
| 5,203,494 | A | 4/1993 | Blomfield | 229/148 |
| 5,294,044 | A | 3/1994 | Clark | 229/191 |
| 5,361,976 | A | 11/1994 | Blomfield | 229/148 |
| 5,429,296 | A | 7/1995 | Southwell et al. | 229/168 |
| 5,431,335 | A | 7/1995 | Gimeno | 229/191 |
| 5,452,848 | A | 9/1995 | Mur Gimeno | 229/191 |
| 5,458,283 | A | 10/1995 | Southwell et al. | 229/178 |
| 5,487,505 | A | 1/1996 | Nilsson | 229/191 |
| 5,535,941 | A | 7/1996 | Garza | 229/191 |
| 5,535,942 | A | 7/1996 | Vilona | 229/191 |
| 5,549,242 | A | 8/1996 | Gimeno | 229/191 |
| 5,597,111 | A | 1/1997 | Mackinnon et al. | |
| 5,649,663 | A | 7/1997 | Pestow, Jr. | 229/190 |
| 5,673,848 | A | 10/1997 | Garza | 229/191 |
| 5,779,136 | A | 7/1998 | Blazquez Garcia. | 229/199 |
| 5,799,861 | A | 9/1998 | Bonner et al. | |
| 5,860,590 | A | 1/1999 | Blomfield et al. | 229/165 |
| 6,131,805 | A | 10/2000 | Gasior | 229/174 |

FOREIGN PATENT DOCUMENTS

| | | | | |
|---|---|---|---|---|
| FR | 2 615 822 | | 12/1988 | B65D/5/30 |
| FR | 2 682 936 | | 4/1993 | B65D/21/02 |
| FR | 2 689 484 | | 10/1993 | B65D/5/30 |
| GB | 799792 | | 8/1958 | |
| GB | 2 043 596 | A | 10/1980 | B65D/5/22 |
| GB | 2 086 352 | A | 5/1982 | B65D/5/42 |
| GB | 2 173 480 | A | 10/1986 | B65D/21/02 |
| GB | 2 188 036 | A | 9/1987 | B65D/5/32 |
| GB | 2 194 776 | A | 3/1988 | B65D/21/02 |
| GB | 2 217 689 | A | 11/1989 | B65D/21/02 |
| GB | 2 226 546 | A | 7/1990 | B65D/5/44 |
| GB | 2 232 403 | A | 12/1990 | B65D/5/20 |
| IT | 556550 | | 2/1957 | |
| NZ | 237169 | | 5/1993 | B65D/21/00 |
| NZ | 25100 | | 12/1997 | |
| NZ | 25101 | | 3/1998 | |
| NZ | 25605 | | 9/1998 | |

STACKABLE SHIPPING CONTAINER

This application is a continuation-in-part of Ser. No. 09/804,290, filed Mar. 12, 2001 now abandoned.

BACKGROUND OF THE INVENTION

1. Field of the Invention

The present invention is directed to shipping containers, such as are used for the shipping of fruit and vegetables, in particular to stackable shipping containers fabricated from paper, paperboard and/or corrugated paperboard.

2. Prior Art

Stackable shipping containers, fabricated in whole or in part, from paper, paperboard and/or corrugated paperboard, are employed for the shipping of fruits and vegetables from packing plants to grocery stores and the like.

Many stackable shipping container designs, particularly those that are lidless (relying upon the bottom of an adjacent upper container to cover the open top of the lower container), use an interior gusseted corner that extends from one side, to an adjacent side. This interior gusseted corner typically forms a diagonal interior corner. This type of interior corner provides good stacking strength and bottom support for any similar containers stacked above. The formation of this corner structure is typically accomplished through two perpendicular and parallel score lines that create an angled corner (typically 45 degrees). While this corner may provide support for a larger surface area, than a container having only a simple 90-degree corner with no diagonal structure, it may also consume potentially valuable container space and volume, taking that volume away from being occupied by product.

Many such open-topped shipping containers are also provided with inclined sidewalls. The purpose of such inclined side walls is to provide additional resistance to outward bulging of the side walls, such as may be caused by products that have large mass per item, such as large tree fruit and the like. The inclined side walls may also provide assistance in obtaining more secure indexing of the stacking alignment tabs that are usually provided on the top edges of the side walls, which are received in slots provided along the edges of the bottom walls of the containers, so that like containers may be stacked to prevent relative lateral movement of one such container stacked atop another such container. By providing inclined walls, the slots in the bottom wall are to the inside of the peripheral edge of the bottom wall, rather than being located at the peripheral edge, so that the bulging forces exerted by the contained product will be less likely to force the tabs to be popped out of their respective slots.

It would be desirable to provide a stackable shipping container that is provided with corner supports that provide added support, in the form of stacking strength, to the bottoms of above-stacked like containers, but without removing so much volume from the volume available for containing product.

It would also be desirable to provide a stackable shipping container, that is provided with inclined side walls, for resistance to bulging, and for permitting more positive indexing of the tabs of one container into the slots in the bottom of an above adjacent stacked container.

These and other desirable characteristics of the invention will become apparent in light of the present specification, including claims, and drawings.

SUMMARY OF THE INVENTION

The present invention is directed in part to a stackable shipping container formed from a blank, wherein the blank comprises a substantially rectangular bottom wall having two perpendicularly arranged pairs of opposed side edge regions. First and second pairs of opposed first sidewalls, emanate from the two perpendicularly arranged pairs of opposed side edge regions. One pair of opposed second sidewalls emanates from first edge regions of the first pair of opposed first sidewalls. Pairs of first minor flaps emanate from second edge regions of each of the first pair of opposed first sidewalls. Pairs of second minor flaps are connected to third edge regions of each of the pair of opposed second sidewalls.

Nonrectangular gusset panels are disposed substantially between the second minor flaps and the respective adjacent end edge regions of the respective second sidewalls.

The first and second pairs of opposed first sidewalls, the pair of opposed second sidewalls, and the pairs of first minor flaps and pairs of second minor flaps are operably configured, upon articulation, so that each of the second sidewalls is folded inwardly, in juxtaposed overlying relation to an inside surface of a respective one of the first pair of first sidewalls, each of the first minor flaps is in juxtaposed overlying relation to an inside surface of a respective adjacent one of the second pair of first sidewalls, and each of the second minor flaps is in juxtaposed overlying relation to an inside surface of a respective one of the first minor flaps.

The nonrectangular gusset panels are provided with a top region having a width that is greater than the width at a bottom region thereof, so that upon articulation of the blank, the nonrectangular gusset panels extend diagonally across corner regions of the stackable shipping container, with the top regions of the nonrectangular gusset panels extending farther inwardly into an interior region of the stackable shipping container than the bottom regions of the nonrectangular gusset panels.

In a preferred embodiment of the invention, one pair of first sidewalls is longer than the other pair of first sidewalls.

In a preferred embodiment of the invention, the first and second minor flaps have angled bottom edges so that upon articulation of the blank, at least the first pair of first side walls and the pair of second sidewalls are inwardly inclined with respect to the bottom wall.

According to one embodiment of the invention, the nonrectangular gusset panels are defined by pairs of fold lines disposed between the second minor flaps and the respective adjacent end edge regions of the respective second sidewalls, in which the fold lines have an acute angle subtended between them.

According to another preferred embodiment of the invention, the fold lines defining the nonrectangular gusset panels do not intersect within the blank. Alternatively, the fold lines defining the nonrectangular gusset panels intersect at the edge regions of the blank. In a still further alternative embodiment, the fold lines defining the nonrectangular gusset panels intersect at positions inwardly removed from edge regions of the blank.

The stackable shipping container further comprises one or more stacking tabs defined by cutout regions disposed between the first pair of opposed first sidewalls and respective ones of the pair of opposed second sidewalls; and one or more stacking tab receiving apertures disposed in the bottom wall. The one or more stacking tabs of the stackable shipping container may be configured to cooperate with and be insertingly received by the slots of a similar stackable shipping container stacked atop the stackable shipping container.

The present invention is directed in part to a blank for a stackable shipping container, wherein the blank comprises a substantially rectangular bottom wall having two perpendicularly arranged pairs of opposed side edge regions. First and second pairs of opposed first sidewalls, emanate from the two perpendicularly arranged pairs of opposed side edge regions. One pair of opposed second sidewalls emanates from first edge regions of the first pair of opposed first sidewalls. Pairs of first minor flaps emanate from second edge regions of each of the first pair of opposed first sidewalls. Pairs of second minor flaps are connected to third edge regions of each of the pair of opposed second sidewalls.

Nonrectangular gusset panels are disposed substantially between the second minor flaps and the respective adjacent end edge regions of the respective second sidewalls.

The first and second pairs of opposed first sidewalls, the pair of opposed second sidewalls, and the pairs of first minor flaps and pairs of second minor flaps are operably configured, upon articulation, so that each of the second sidewalls is folded inwardly, in juxtaposed overlying relation to an inside surface of a respective one of the first pair of first sidewalls, each of the first minor flaps is in juxtaposed overlying relation to an inside surface of a respective adjacent one of the second pair of first sidewalls, and each of the second minor flaps is in juxtaposed overlying relation to an inside surface of a respective one of the first minor flaps.

The nonrectangular gusset panels are provided with a top region having a width that is greater than the width at a bottom region thereof, so that upon articulation of the blank, the nonrectangular gusset panels extend diagonally across corner regions of the stackable shipping container, with the top regions of the nonrectangular gusset panels extending farther inwardly into an interior region of the stackable shipping container than the bottom regions of the nonrectangular gusset panels.

In a preferred embodiment of the invention, one pair of first sidewalls is longer than the other pair of first sidewalls.

In a preferred embodiment of the invention, the first and second minor flaps have angled bottom edges so that upon articulation of the blank, at least the first pair of first side walls and the pair of second sidewalls are inwardly inclined with respect to the bottom wall.

According to one embodiment of the invention, the nonrectangular gusset panels are defined by pairs of fold lines disposed between the second minor flaps and the respective adjacent end edge regions of the respective second sidewalls, in which the fold lines have an acute angle subtended between them.

According to another preferred embodiment of the invention, the fold lines defining the nonrectangular gusset panels do not intersect within the blank. Alternatively, the fold lines defining the nonrectangular gusset panels intersect at the edge regions of the blank. In a still further alternative embodiment, the fold lines defining the nonrectangular gusset panels intersect at positions inwardly removed from edge regions of the blank.

The blank further comprises one or more stacking tabs defined by cutout regions disposed between the first pair of opposed first sidewalls and respective ones of the pair of opposed second sidewalls; and one or more stacking tab receiving apertures disposed in the bottom wall. The one or more stacking tabs, upon articulation of the blank into a stackable shipping container may be configured to cooperate with and be insertingly received by the slots of a similarly articulated similar blank articulated into a similar stackable shipping container stacked atop the stackable shipping container formed from the articulated blank.

According to an alternative embodiment of the invention, the stackable shipping container is formed from a blank that is configured so that the first and second minor flaps emanate from the first pair of first side walls and the pair of second sidewalls, respectively, by inclined fold lines, so that upon articulation of the blank, the second pair of first sidewalls are also inwardly inclined with respect to the bottom wall.

The present invention also includes, in an alternative embodiment, a blank having first and second minor flaps emanating from the first pair of first side walls and the pair of second sidewalls, respectively, by inclined fold lines, so that upon articulation of the blank, the second pair of first sidewalls are also inwardly inclined with respect to the bottom wall.

The present invention is also directed to a stackable shipping container formed from a blank. The blank comprises a substantially rectangular bottom wall having two perpendicularly arranged pairs of opposed side edge regions. First and second pairs of opposed first sidewalls emanate from the two perpendicularly arranged pairs of opposed side edge regions. One pair of opposed second sidewalls emanate from first edge regions of the first pair of opposed first sidewalls. Pairs of first minor flaps emanate from second edge regions of each of the first pair of opposed first sidewalls. Pairs of second minor flaps are connected to third edge regions of each of the pair of opposed second sidewalls. Non-rectangular gusset panels are disposed substantially between the second minor flaps and the respective adjacent end edge regions of the respective second sidewalls. The first and second pairs of opposed first sidewalls, the pair of opposed second sidewalls, and the pairs of first minor flaps and pairs of second minor flaps are operably configured, upon articulation, so that each of the second sidewalls is folded inwardly, in juxtaposed overlying relation to an inside surface of a respective one of the first pair of first sidewalls, each of the first minor flaps is in juxtaposed overlying relation to an inside surface of a respective adjacent one of the second pair of first sidewalls, and each of the second minor flaps is in juxtaposed overlying relation to an inside surface of a respective one of the first minor flaps. Each of the non-rectangular gusset panels being defined by pairs of fold lines, each of which extend substantially obliquely with respect to fold lines separating the opposed first sidewalls from the bottom wall.

The present invention is also directed to a stackable shipping container formed from a blank. The blank comprises a substantially rectangular bottom wall having two perpendicularly arranged pairs of opposed side edge regions. First and second pairs of opposed first sidewalls emanate from the two perpendicularly arranged pairs of opposed side edge regions. One pair of opposed second sidewalls emanate from first edge regions of the first pair of opposed first sidewalls. Pairs of first minor flaps emanate from second edge regions of each of the first pair of opposed first sidewalls. Pairs of second minor flaps are connected to third edge regions of each of the pair of opposed second sidewalls. Rectangular gusset panels are disposed substantially between the second minor flaps and the respective adjacent end edge regions of the respective second sidewalls. The first and second pairs of opposed first sidewalls, the pair of opposed second sidewalls, and the pairs of first minor flaps and pairs of second minor flaps are operably configured, upon articulation, so that each of the second sidewalls is folded inwardly, in juxtaposed overlying relation to an inside surface of a respective one of the first pair of first sidewalls, each of the first minor flaps is in juxtaposed overlying relation to an inside surface of a respective adjacent one of the second pair of first sidewalls, and each of the second minor flaps is in juxtaposed overlying relation to an inside surface of a respective one of the first minor flaps. Each of the rectangular gusset panels being defined by pairs of fold lines, each of which extend substantially obliquely with respect to fold lines separating the opposed first sidewalls from the bottom wall.

DETAILED DESCRIPTION OF THE DRAWINGS

Figure 1A:
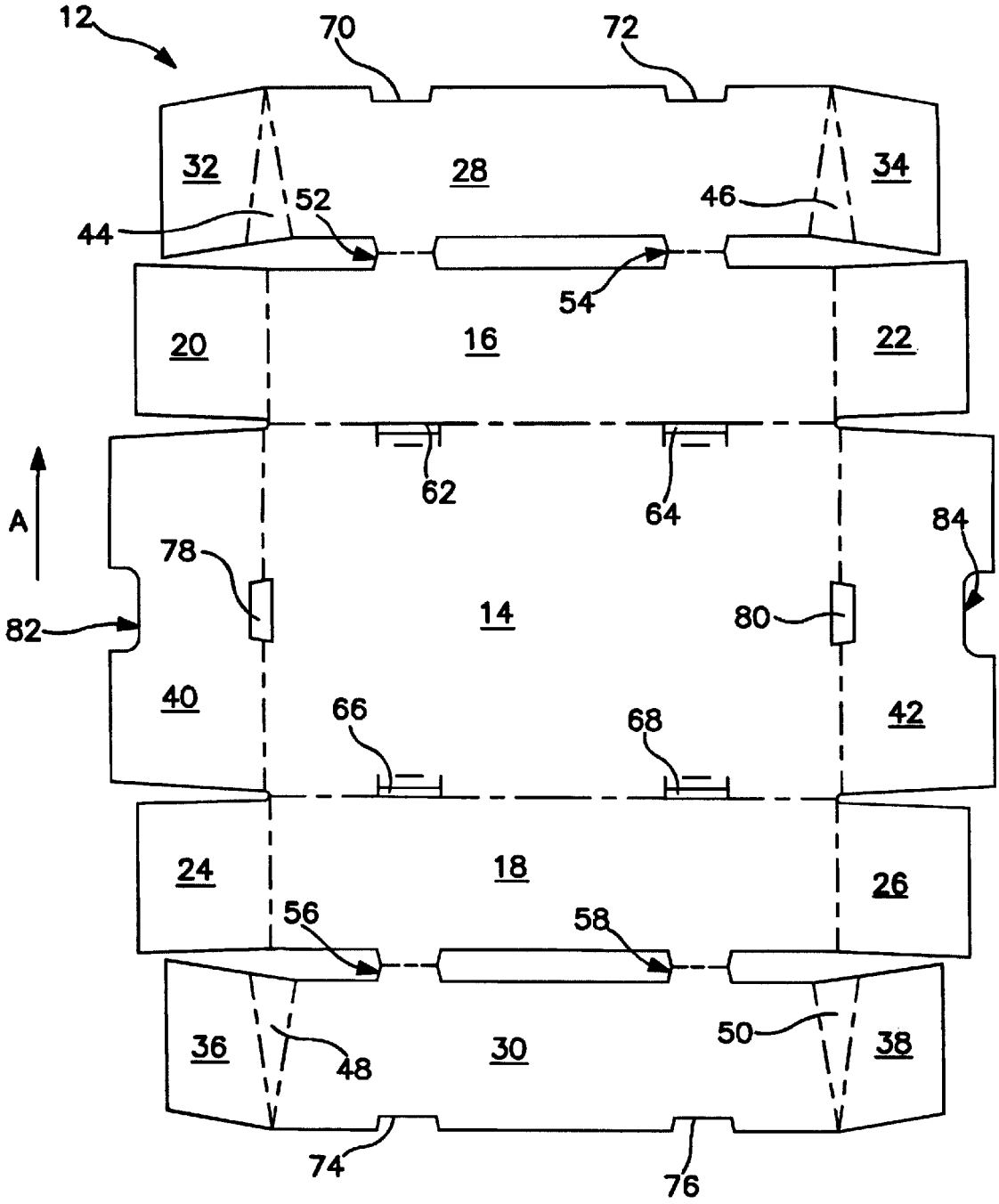
FIG. 1A is a plan view of a blank for a stackable shipping container according to one embodiment of the present invention.

While this invention is susceptible of embodiment in many different forms, there is shown in the drawings and will be described herein in detail, a specific embodiment, with the understanding that the present invention is to be considered as an exemplification of the principles of the invention and is not intended to limit the invention to the embodiment illustrated.

In the present disclosure, unless otherwise expressly noted or apparent from the disclosure, the convention applies that broken lines shown in the interior of a blank represent creases, perforations, fold lines or similar lines of weakness, while solid continuous lines shown in the interior of a blank represent continuous cuts through the blank material, or the boundary of an aperture in the blank.

Figure 1B:
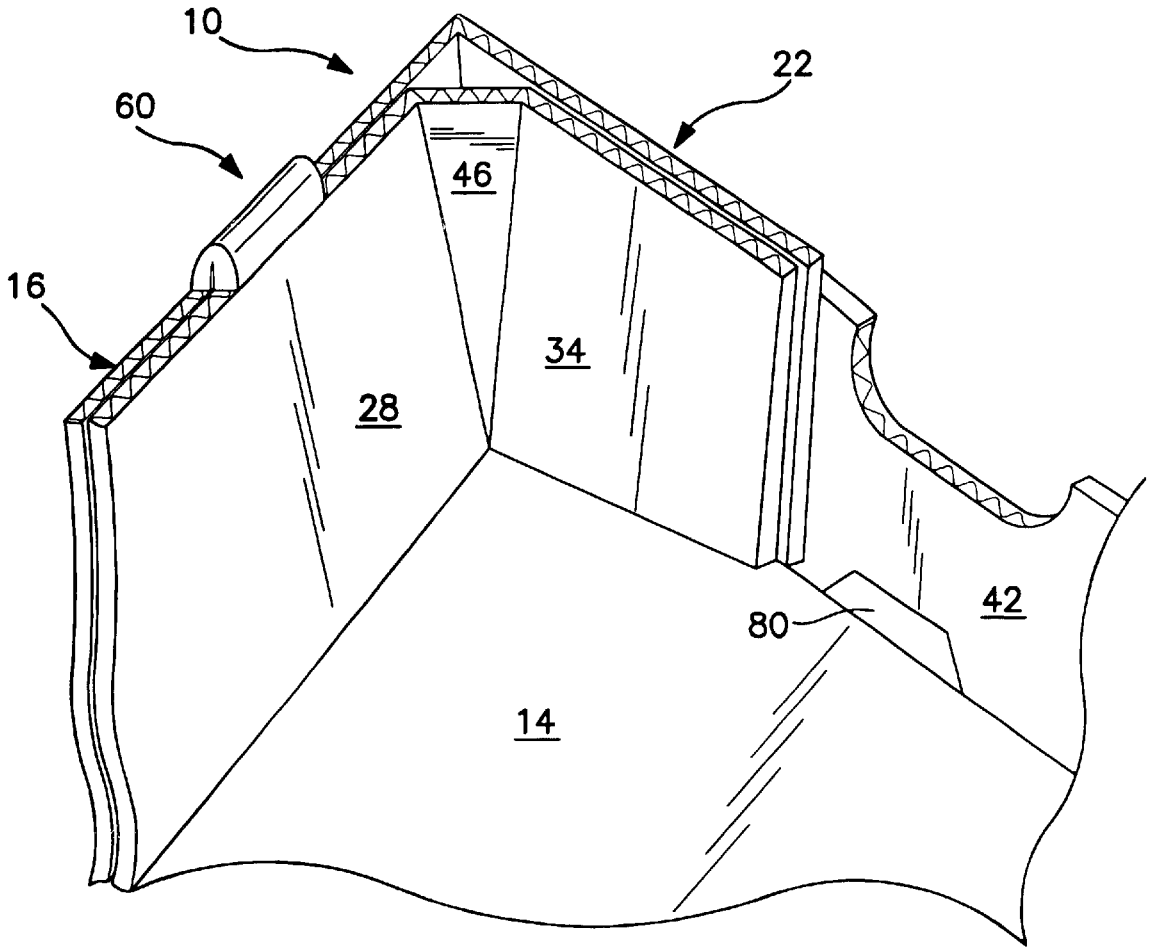
FIG. 1B is a fragmentary perspective view of a corner of a shipping container articulated from the blank of FIG. 1A.

FIG. 1A is a plan view of a blank for a stackable shipping container according to one embodiment of the present invention. FIG. 1B is a fragmentary perspective view of a corner of a shipping container raised from the blank of FIG. 1A.

Container 10 (FIG. 1B) is formed from blank 12, which is preferably fabricated from corrugated paperboard material. In a preferred embodiment of the invention, as it is desirable that the "long" sides of a container having a non-square footprint have vertical flutes, for maximized strength, in blank 12, the flutes will extend parallel to arrow A.

Blank 12 includes bottom wall 14; outer side walls 16, 18 with respective minor flaps 20, 22, 24, 26; inner long sidewalls 28, 30 with respective minor flaps 32, 34, 36, 38; and short end walls 40, 42. All of the minor flaps are non-rectangular, and short end walls 40, 42 are preferably trapezoidal, to facilitate placement of the inner and outer long sidewalls in slightly inwardly inclined (e.g., 2–6 degrees from the perpendicular) positions.

Generally V-shaped pairs of lines of weakness define gussets 44, 46, 48 and 50. In the present embodiment, each of the lines of weakness in the pairs extends substantially obliquely relative to the fold lines extending between bottom wall 14 and respective outer side walls 16, 18.

Webs 52, 54, 56 and 58 connect the top edge regions of the inner and outer long sidewalls, to form upwardly extending tabs, such as tab 60, shown in FIG. 1B. Rectangular cutouts 62, 64, 66 and 68.

Inner side walls 28, 30 are provided with cutout regions 70, 72, 74, 76, which, upon articulation of the blank, provide spaces for accommodating the tabs (e.g., tab 60) formed by webs 52, 54, 56 and 58 of an underlying similar container.

Blank 12 may also be provided with cutouts 78, 80, 82, 84, which may be provided for ventilation, etc.

FIG. 1B shows a corner of a shipping container 10, formed through articulation of blank 12. Blank 12 is particularly well-suited for being raised and glued through suitably configured automated carton folding equipment, appropriately modified by one of ordinary skill in the art, having the present disclosure before them.

According to one embodiment of the invention, articulation of blank 12 into container 10 may be accomplished by first folding up the outer long sidewalls 16, 18 to positions approximately perpendicular to bottom wall 14. Minor flaps 20, 22, 24, 26 are then folded inwardly, so that their bottom edges are substantially parallel to the fold lines separating bottom wall 14 from short end walls 40, 42.

Because what become the bottom edges of minor flaps 20, 22, 24, 26 are angled, when those bottom edges are brought down against the upper surface of bottom wall 14, outer side walls 16, 18 become slightly inwardly inclined, the amount of the inclination being at least partly dependent upon the degree of angling of the bottom edges of those minor flaps. Short end walls 40, 42 may then be raised to positions substantially or entirely perpendicular to bottom wall 14. The minor flaps 20, 22, 24, 26 may then be adhesively affixed to the inside surfaces of short end walls 40, 42.

Inner long sidewalls 28, 30, which at this point in the procedure are extending upwardly from the top edges of outer long sidewalls 16, 18 are then folded inwardly, about the fold lines formed in webs 52, 54, 56, 58. More or less simultaneously, minor flaps 32, 34, 36, 38 and corresponding gussets 44, 46, 48 and 50 are folded in toward respective inner side walls 28, 30. Ultimately, inner long sidewalls 28, 30 are disposed inside, substantially parallel and against the inside surfaces of outer long sidewalls 16, 18, respectively. The outwardly facing surfaces of minor flaps 32, 34, 36 and 38 are then positioned against the inwardly facing surfaces of minor flaps 20, 22, 24, 26, respectively, and adhesively affixed thereto. Again, the bottom edges of minor flaps 32, 34, 36 and 38 are angled, so that when the bottom edges are brought down against bottom wall 14, inner side walls are permitted to similarly adopt slightly inwardly inclined orientations.

Gussets 44, 46, 48, 50 then adopt positions such as that shown by gusset 46 in FIG. 1B, wherein the top edge of gusset 46 extends diagonally across the corner of the container, thus providing an edge providing enhanced support for the bottom of a container stacked atop the illustrated container. Because gusset 46 is generally triangular (as a result from the V-shaped scores), with the bottom of gusset 46 extending substantially down to the bottom of the corner, a supporting edge is provided while freeing up volume at the bottom of the gusset. In the embodiment of shipping containers for produce and the like, the ability to enhance useful volume by even a few percentage points, while attempting to keep the same or only slightly increased amounts of corrugated paperboard in the blank, is highly desirable.

The side walls of such a container may be raised, using the generally known technique of pressing the blank down into a mandrel (a depression formed by a plurality of panels and/or guide bars, some of which may be resiliently mounted, with a plurality of panels and guide bars, such as would be readily recognized and employed by one of ordinary skill in the art having the present disclosure before them. Advantageously placed and controlled adhesive applicators, as are known in the art, apply adhesive in a desired predetermined sequence, to surfaces of the minor flaps and/or the side walls, and the various side walls and minor flaps are held in place, while the applied adhesive sets.

In preferred embodiments of the invention, each of the lines of weakness that defines one of the diagonally extending gussets preferably extends non-perpendicularly (i.e., at an oblique angle) with respect to the fold lines that separate the bottom wall from the outer long sidewalls.

Figure 2:
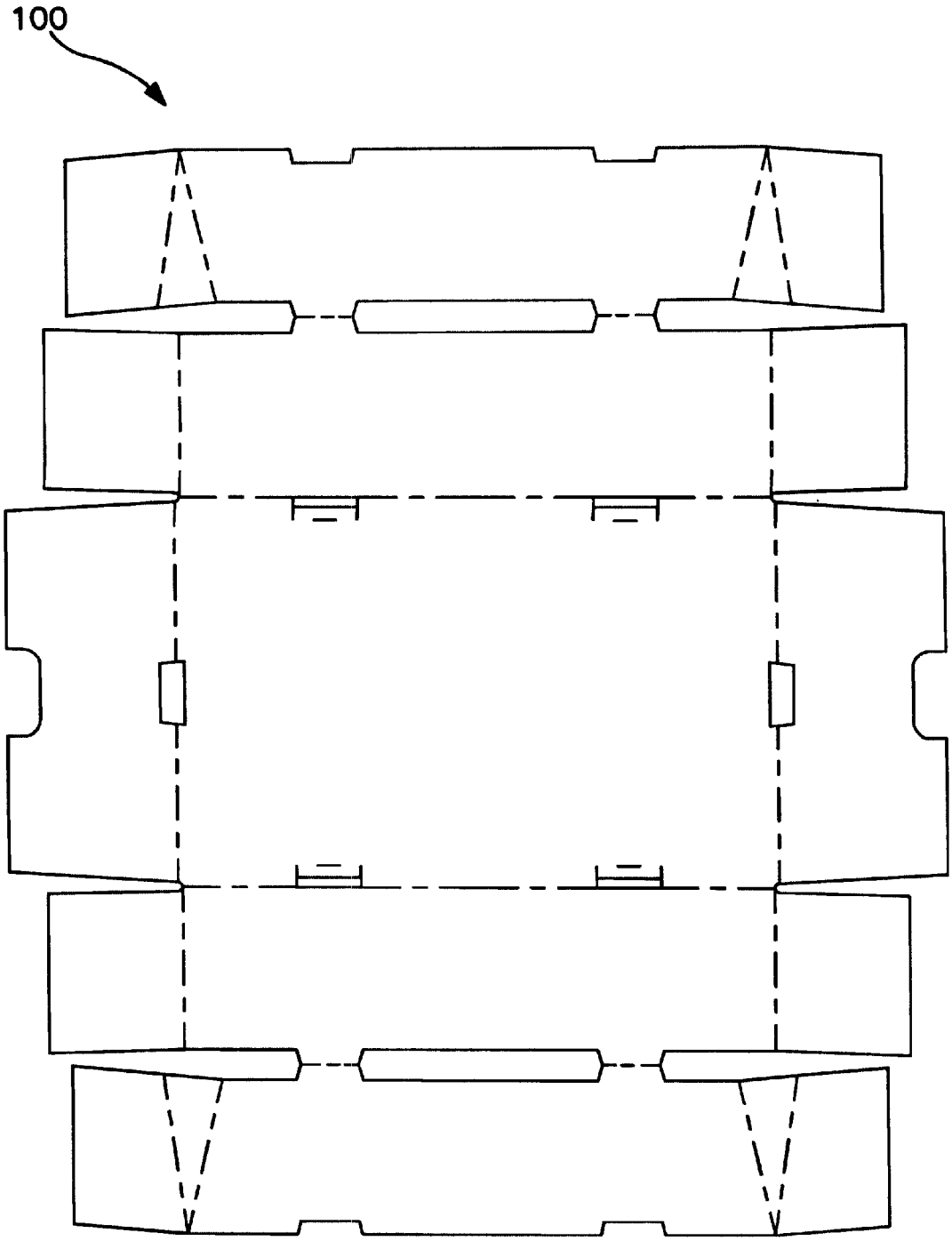
FIG. 2 is a plan view of a blank for a stackable shipping container according to another embodiment of the present invention.

FIG. 2 is a plan view of a blank 100 for a stackable shipping container according to another embodiment of the present invention, which is similar to the embodiment of FIG. 1, but has a slightly greater amount of inward angling of the inner and outer side walls.

Figure 3:
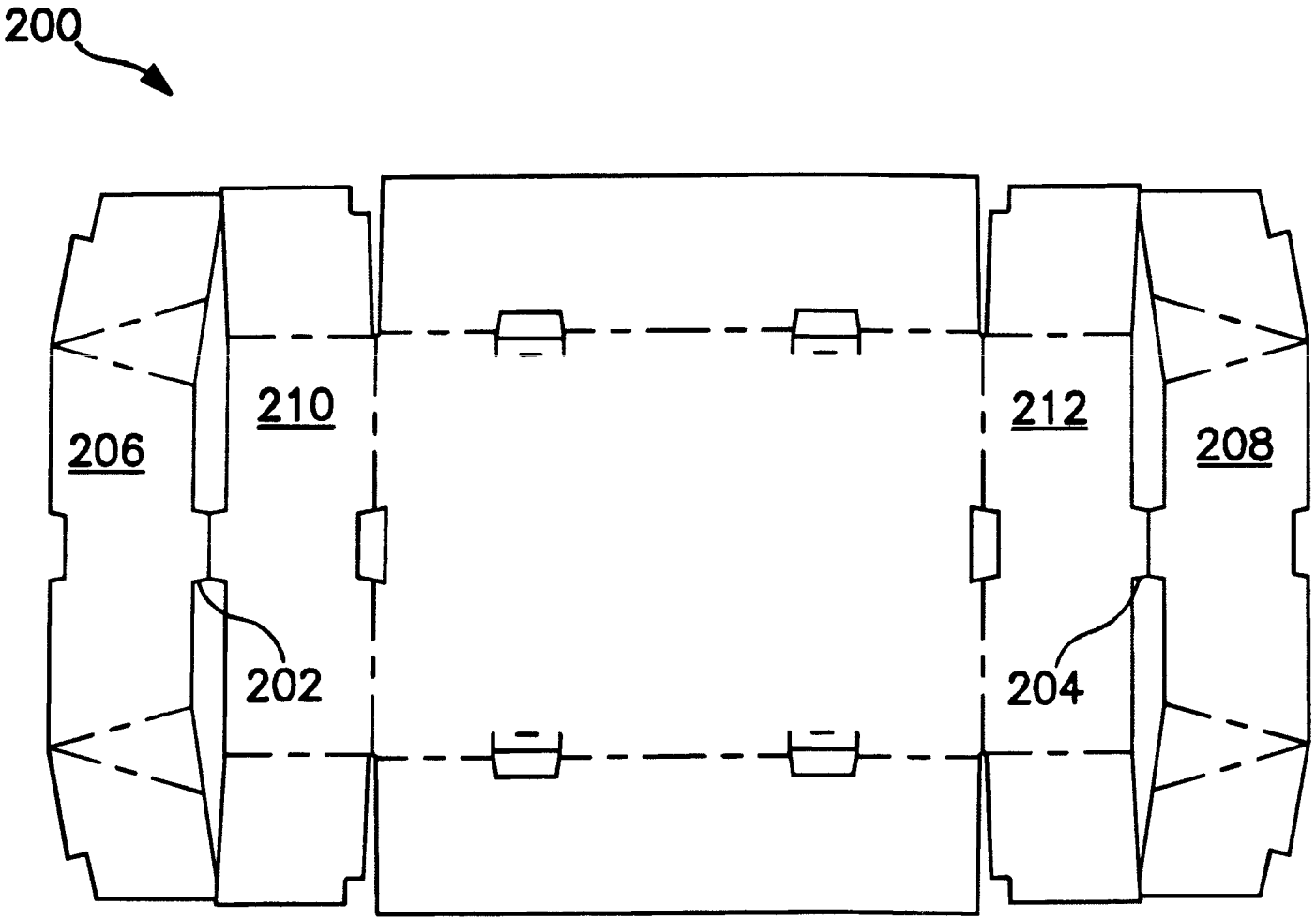
FIG. 3 is a plan view of a blank for a stackable shipping container according to another embodiment of the present invention.

FIG. 3 is a plan view of a blank 200 for a stackable shipping container according to another embodiment of the present invention, wherein the shorter walls of the container are inwardly angled. As such, the stacking tabs are likewise provided in the short end walls, formed by the webs 202, 204, upon folding in of inner short end walls 206, 208 to the inside and against outer short end walls 210, 212. The notches at the corners of the minor flaps are provided, to align with the trapezoidal apertures at the bases of the outer short end walls, to provide access for entry by the tabs formed by the webs.

Figure 4:
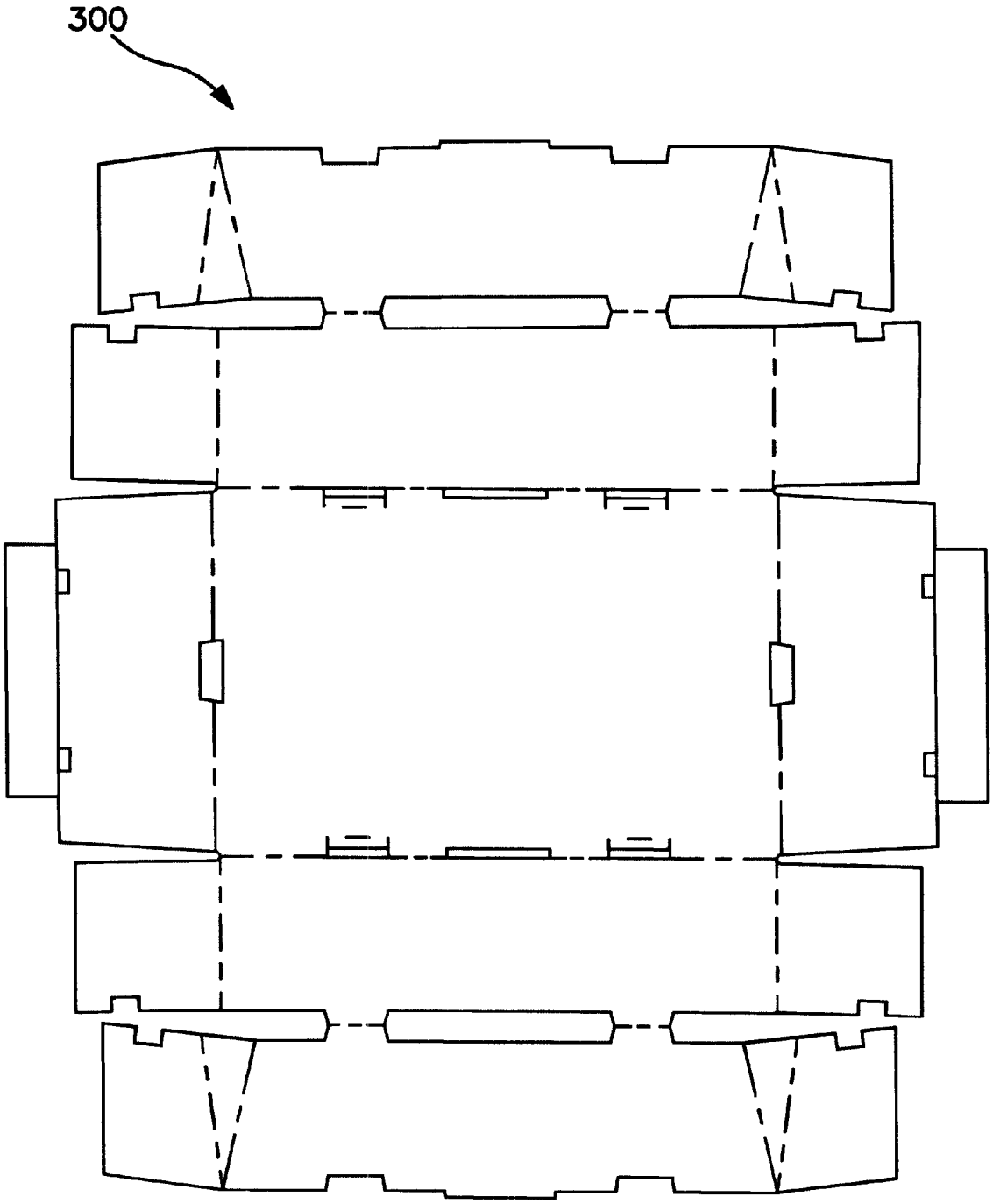
FIG. 4 is a plan view of a blank for a stackable shipping container according to another embodiment of the present invention.

FIG. 4 is a plan view of a blank 300 for a stackable shipping container according to another embodiment of the present invention. Unlike other constructions, the embodiment of FIG. 4 is self-locking. Tabs are provided in the free edges of the inner long sidewalls that engage slots at the bases of the outer long sidewalls, to maintain the long sidewalls in their erected configuration. Notches are provided in the edges of the minor flaps that end up on the top edges of the container, when the blank is articulated. These notches align with cuts in the single panel short sidewalls. Short flaps extend along and emanate from the single panel short sidewalls, and engage with the notches in the minor flap edges. Thus, while the adhesive affixation described with respect to the other embodiments may be used, it may be omitted or reduced in this embodiment.

Figure 5:
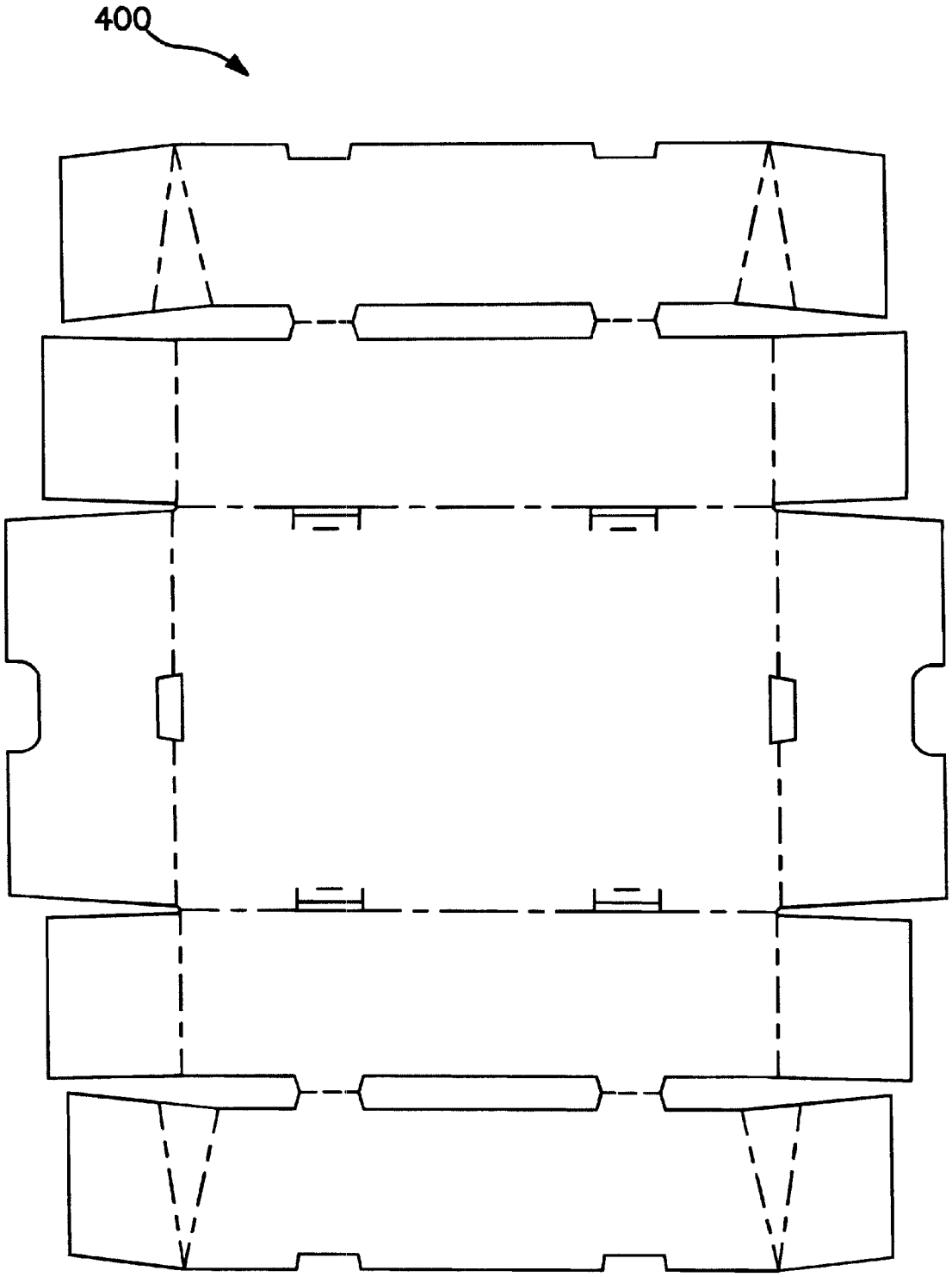
FIG. 5 is a plan view of a blank for a stackable shipping container according to another embodiment of the present invention.
Figure 6:
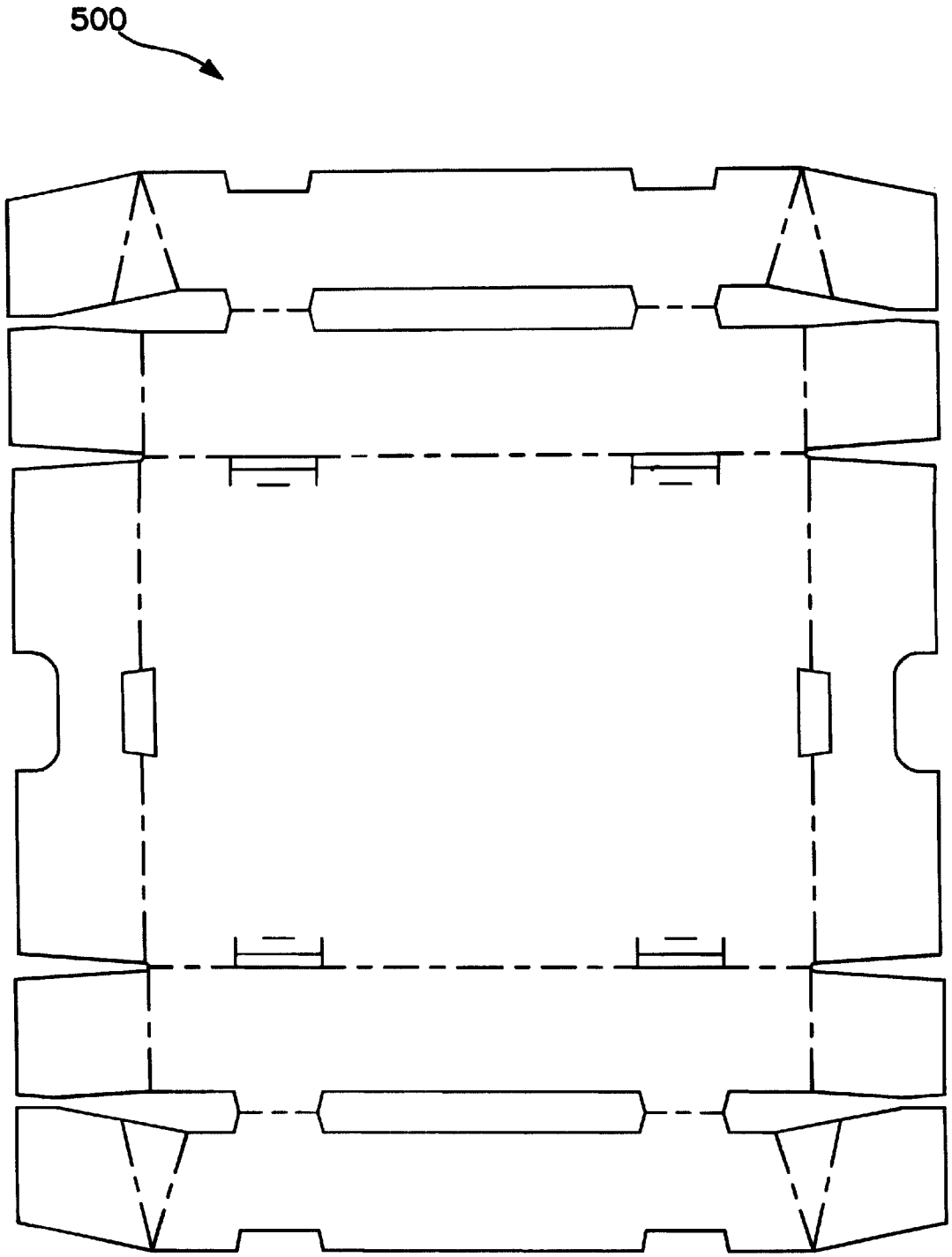
FIG. 6 is a plan view of a blank for a stackable shipping container according to another embodiment of the present invention.
Figure 7:
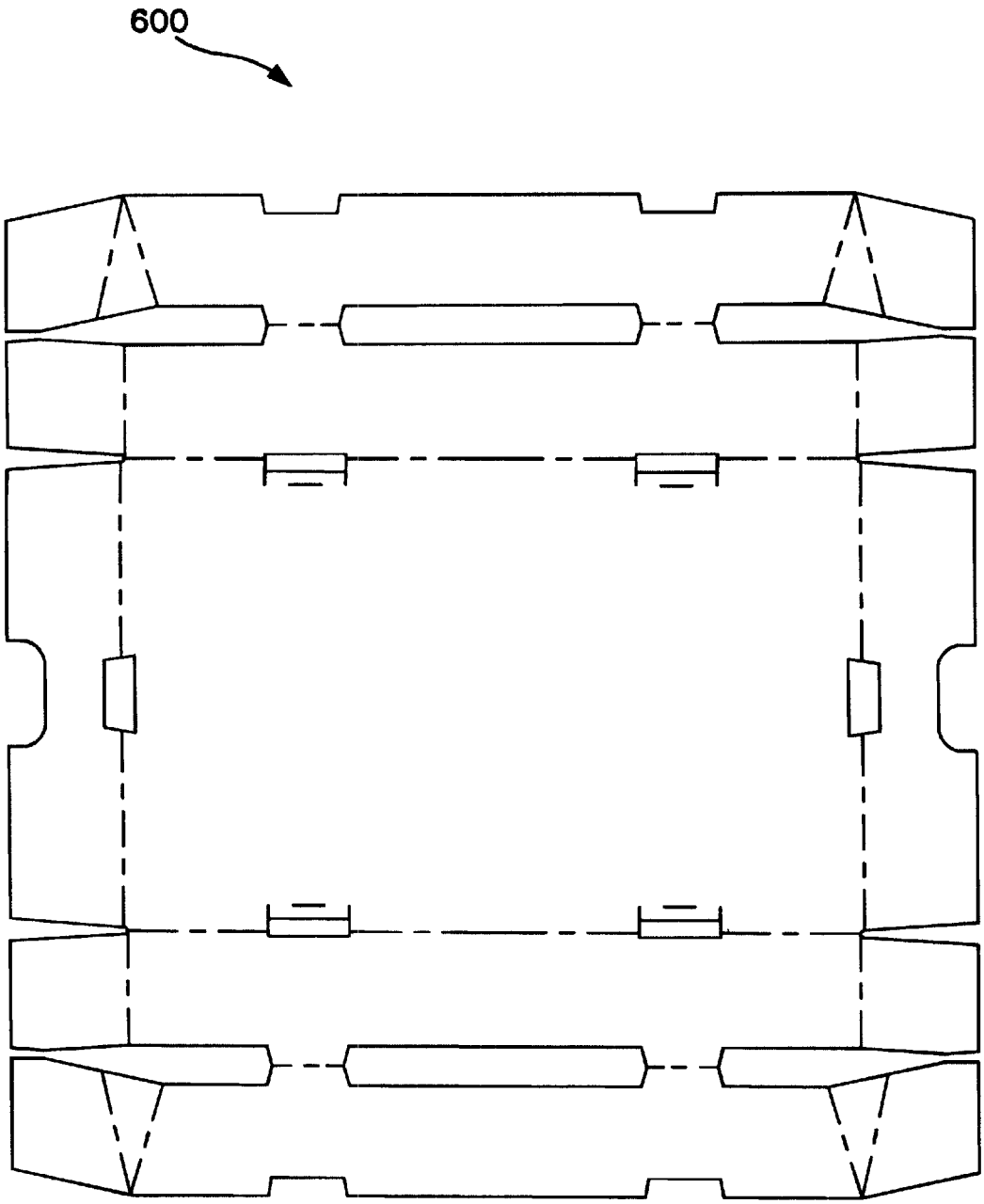
FIG. 7 is a plan view of a blank for a stackable shipping container according to yet another embodiment of the present invention.
Figure 8:
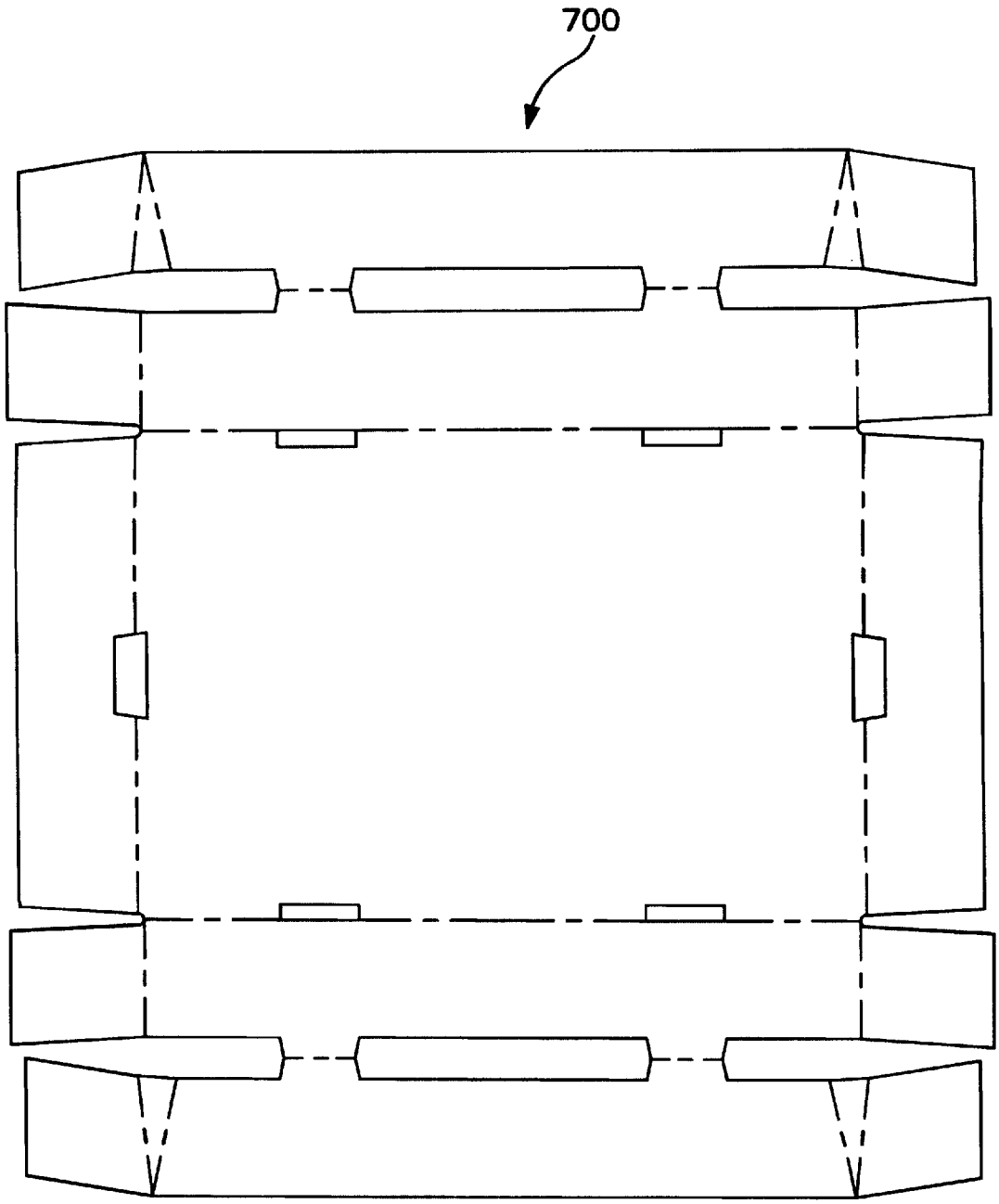
FIG. 8 is a plan view of a blank for a stackable shipping container according to still yet another embodiment of the present invention.

FIG. 5 is a plan view of a blank 400 for a stackable shipping container according to another embodiment of the present invention, similar to the embodiment of FIGS. 1A and 1B, but with slightly different angling of the side walls. FIG. 6 is a plan view of a blank 500 for a stackable shipping container according to another embodiment of the present invention. FIG. 7 is a plan view of a blank 600 for a stackable shipping container according to another embodiment of the present invention. FIG. 8 is a plan view of a blank 700 for a stackable shipping container according to another embodiment of the present invention.

Figure 9:
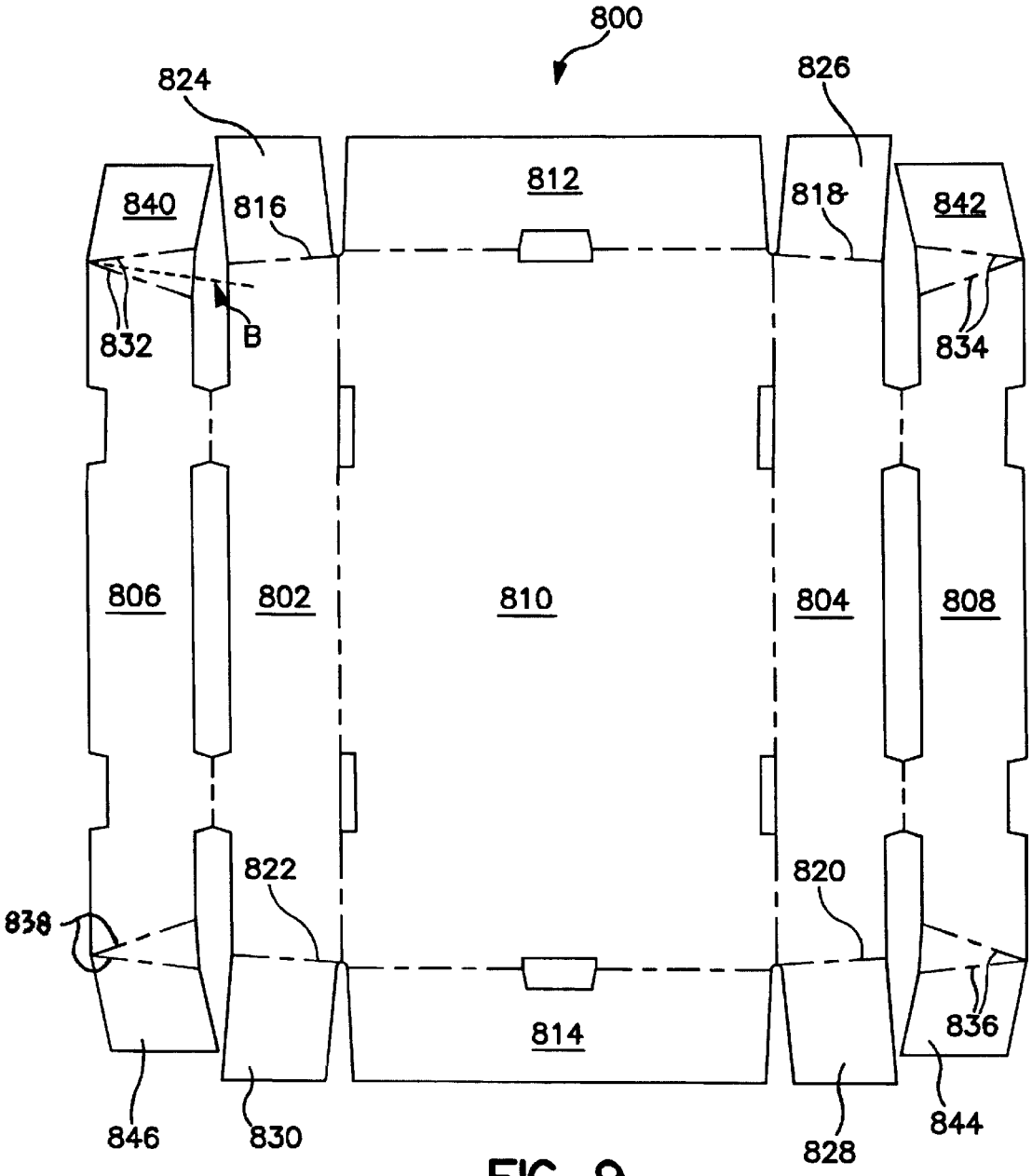
FIG. 9 is a plan view of a blank for a stackable shipping container according to yet another embodiment of the present invention, in which all the raised sidewalls, in the articulated blank, are inwardly inclined.

FIG. 9 is a plan view of a blank 800 for a stackable shipping container according to another embodiment of the invention, in which not only do the indexing long side walls 802, 804, 806, 808 incline inwardly with respect to the bottom wall 810, but short single panel side walls 812, 814 incline inwardly as well. This is accomplished, in part, by angling the folded lines 816, 818, 820, 822, that separate minor flaps 824, 826, 828 and 830, from long side walls 802, 804. Similarly, the V-shaped pairs of fold lines 832, 834, 836, 838, which create the special V-shaped space saving gussets of the present invention, are tilted. That is, the lines bisecting the pairs of fold lines (e.g., line B) extend at non-perpendicular, oblique angles with respect to the fold lines separating bottom wall 810 from long sidewalls 802, 804.

Figure 10:
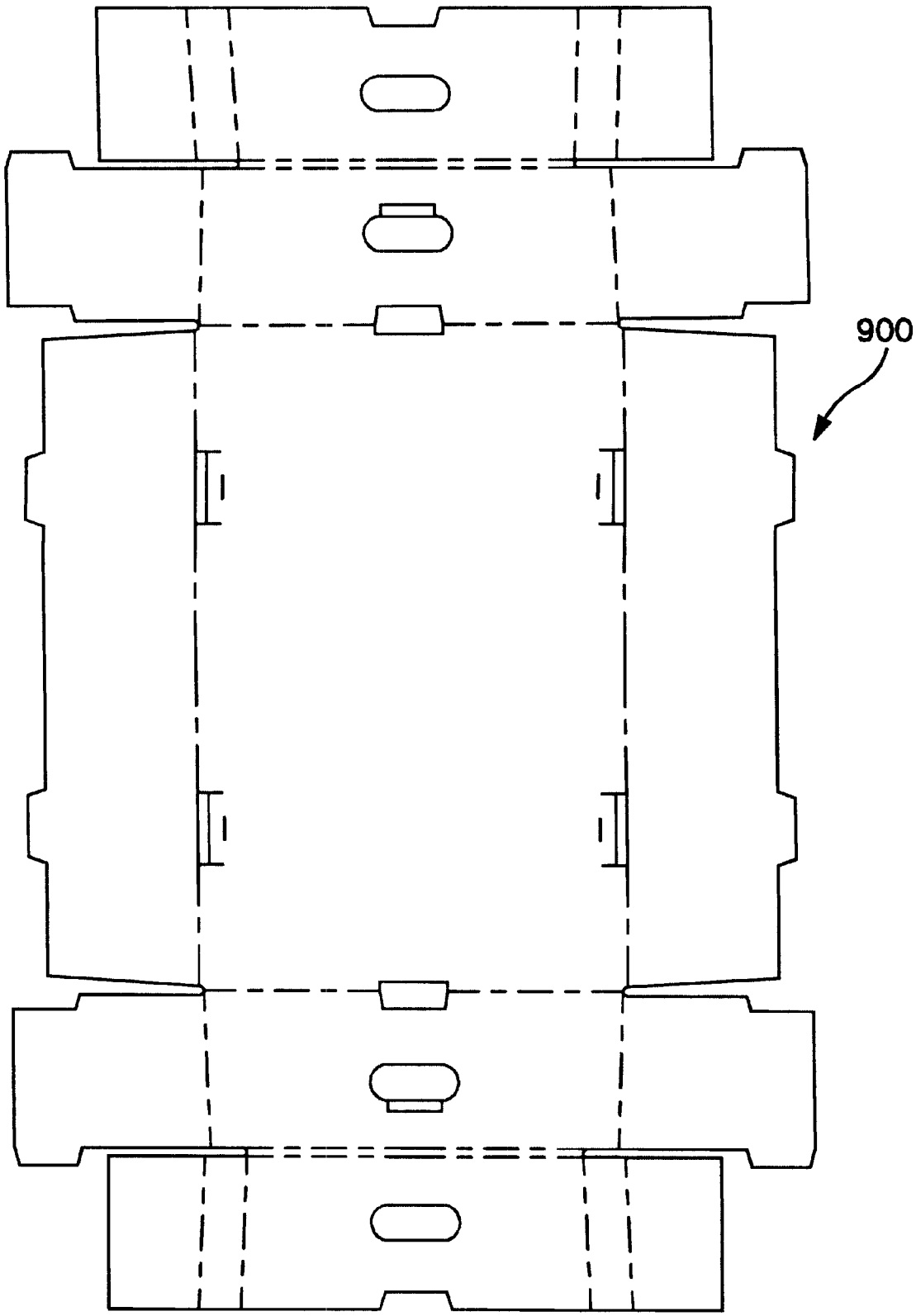
FIG. 10 is a plan view of a blank for a stackable shipping container according to yet another embodiment of the present invention.

FIG. 10 is a plan view of another blank 900 for a stackable shipping container according to another embodiment of the invention, in which the gussets are formed from parallelograms, with both fold lines for each gusset extending at oblique angles to the fold lines separating their corresponding outer side walls from the bottom wall. In addition, like the construction of FIG. 9, all four raised sides of the container are inwardly inclined.

In forming the container from blank 800, long side walls 806, 808 are folded over to the inside of long side walls 802, 804, which are raised up, past the perpendicular into their inwardly inclined positions (enabled by the angled bottom edges of minor flaps 824, 826, 828, 830, and the angled outer edges of minor flaps 840, 842, 844, 846). The incline of fold lines 816, 818, 820, 822 permit short side walls 812, 814 to also be folded up, past the perpendicular, to inwardly inclined positions, where they remain, upon setting of the adhesive applied between the successive adjacent minor flaps and between the minor flaps and short side walls 812, 814. A container formed from blank 800 may have even better stacking strength and resistance to outward bulging, due to the fact that all of its sidewalls incline inwardly.

In the embodiments shown, the gussets are triangular, in that the pairs of fold lines defining the gussets intersect at the adjacent edges of the blank. In alternative embodiments of the invention, the pairs of fold lines may not intersect at the blank edge, but may simply converge, thus creating trapezoidal gusset panels. Alternatively, the fold lines may intersect at some point removed from the blank edge, so that the gussets take on a slightly Y-shaped configuration.

Figure 11:
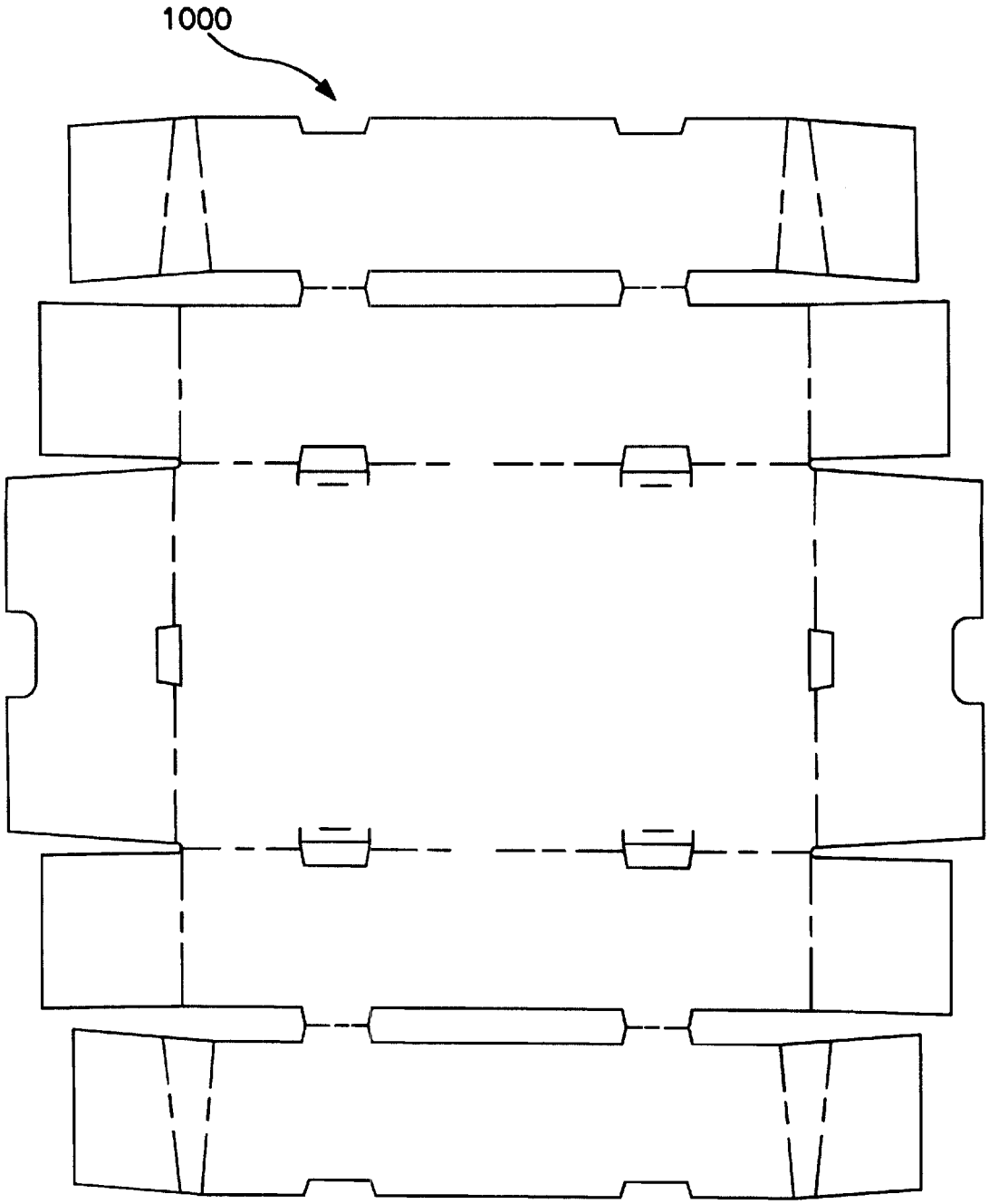
FIG. 11 is a plan view of yet another blank for still another embodiment of the present invention.
Figure 12:
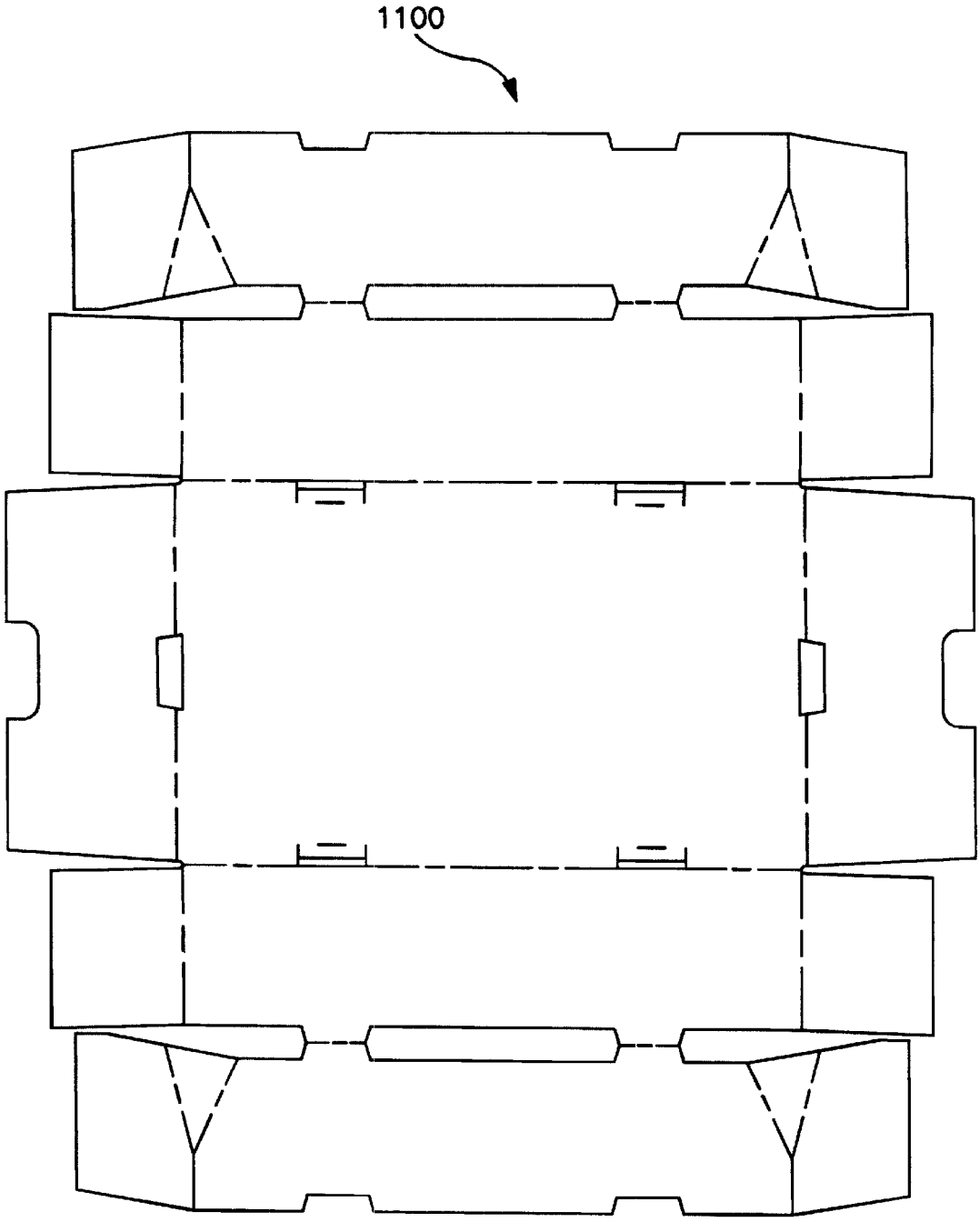
FIG. 12 is a plan view of yet another blank for still another embodiment of the present invention.
Figure 13:
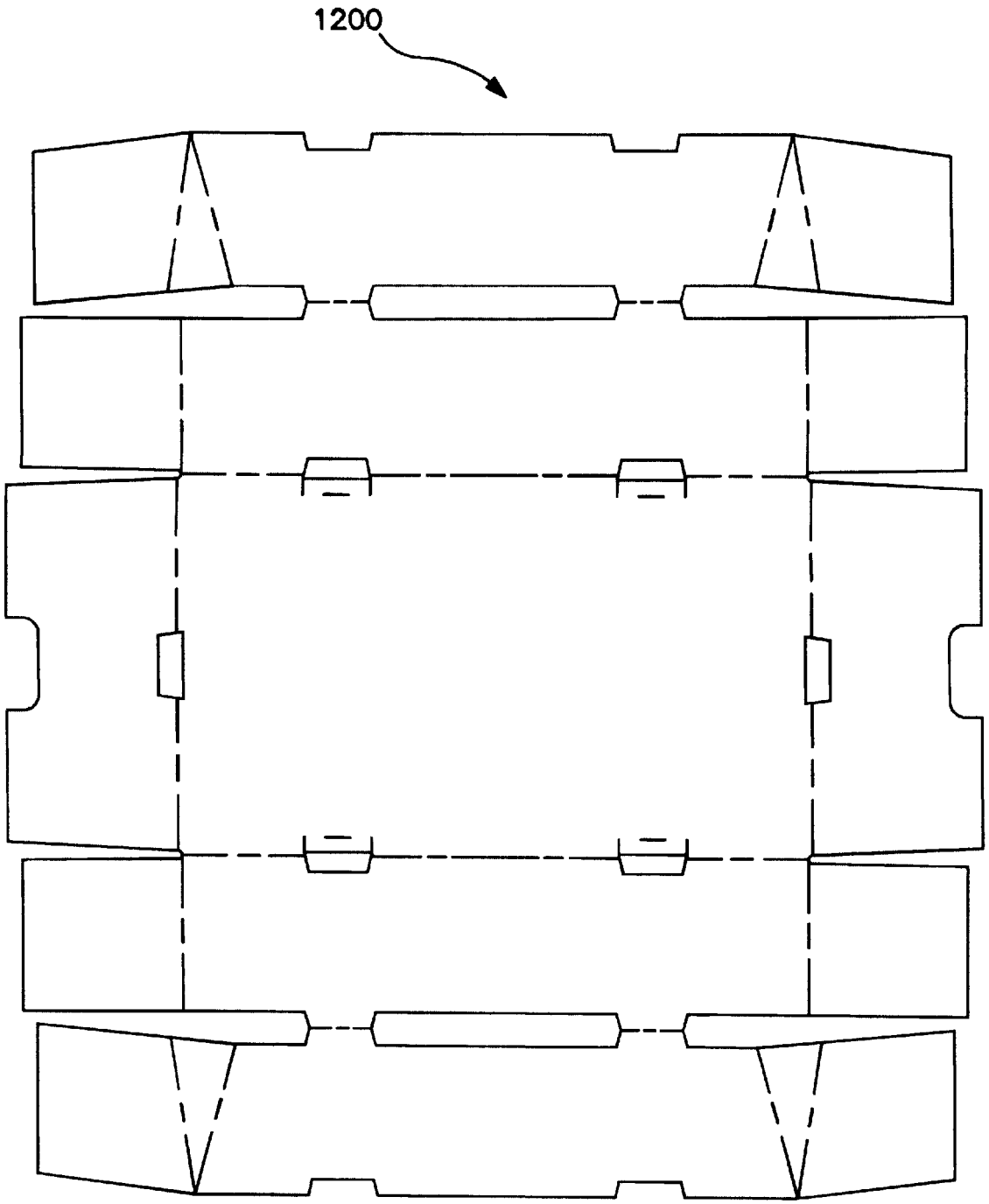
FIG. 13 is a plan view of yet another blank for still another embodiment of the present invention.
Figure 14:
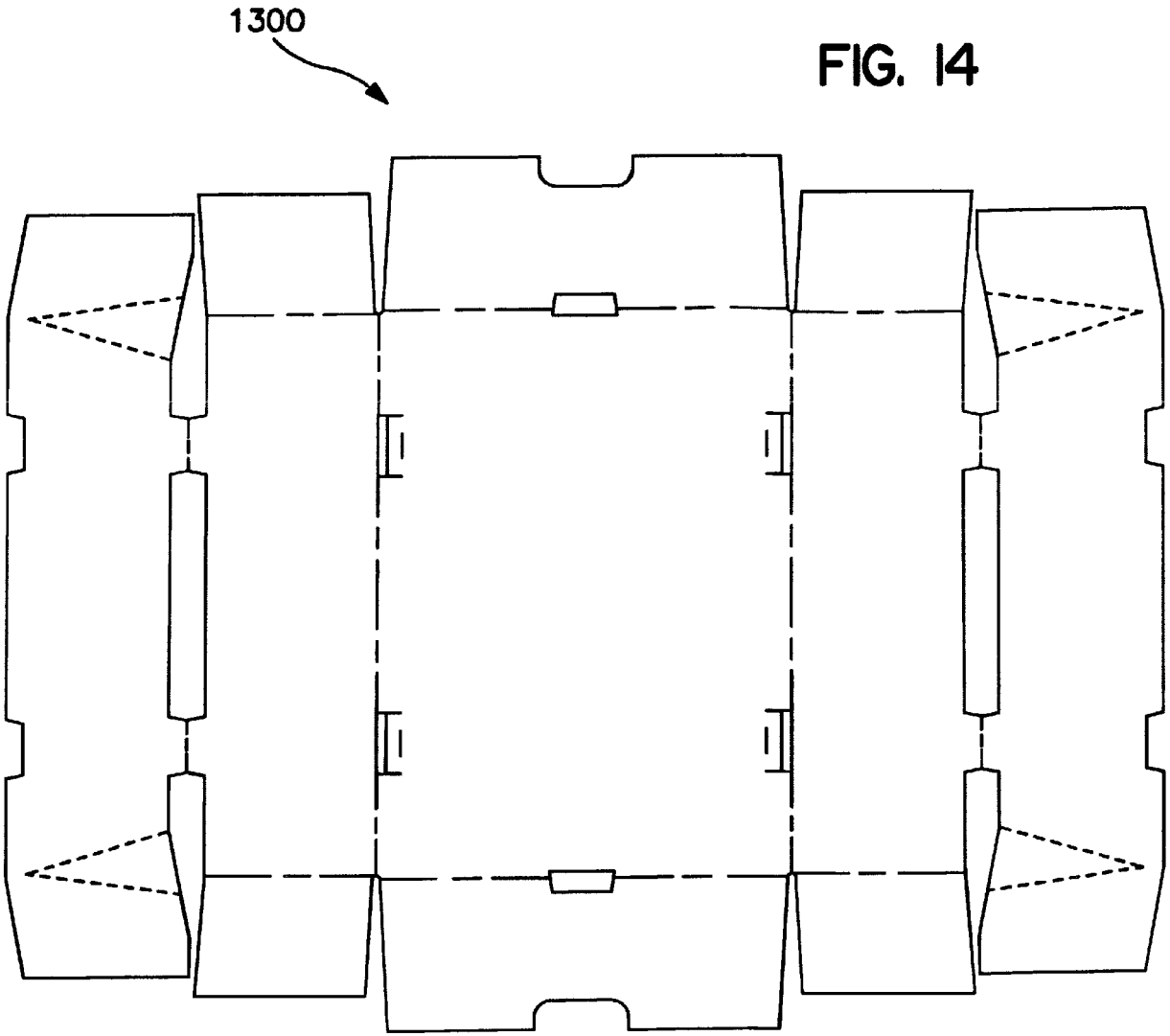
FIG. 14 is a plan view of yet another blank for still another embodiment of the present invention.

For example, in FIG. 11, blank 1000 is provided with gussets that are trapezoidal in shape, in that the converging fold lines defining the gusset intersect outside of the blank. The gusset still retains a top edge wider than the bottom edge. In FIG. 12, blank 1100 is provided with gussets that are Y-shaped, in that the fold lines that define the gusset converge within the boundaries of the inner sidewall, that is continued as a single fold line to the blank edge. In FIG. 13, blank 1200 is provided with V-shaped gussets that are defined by fold lines that converge at the blank edge. However, in this embodiment, the indexing sidewalls are not inclined, but vertical. The angling of the minor flaps that emanate from the gusset regions is provided to accommodate the gussets, to ensure that the V-score of each gusset will be appropriately aligned in its respective corner defined by the corresponding outer sidewall and its respective minor flaps. FIG. 14 shows another example of a gusset in which the preformed scores for the fold lines converge inwardly of the edge of blank 1300.

In the embodiments of FIGS. 11 and 13, an additional feature is shown in that the outside sidewalls are cut away, exposing the corresponding indexing tabs when the containers are stacked.

Figure 15:
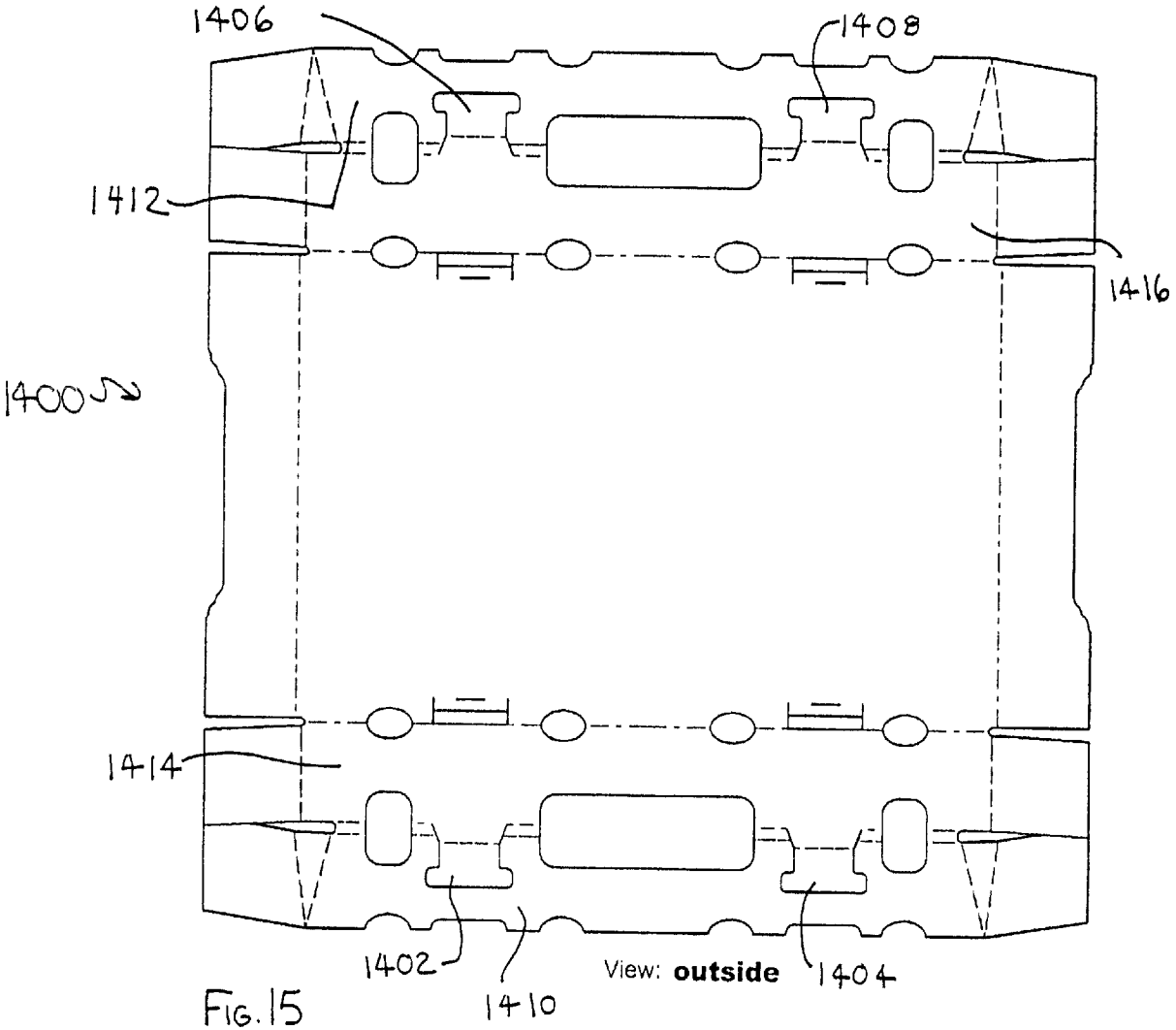
FIG. 15 is a plan view of still another blank for another alternative embodiment of the present invention.

FIG. 15 illustrates a blank for another embodiment of the invention. Aside from the triangular gusset panels evident in the drawing, which function in a manner similar to that of the previously-described embodiments, blank 1400 includes die-cut stacking tabs 1402–1408, that are cut from the inner length wall panels 1410 and 1412. The stacking tabs become separated from the inner length wall panels, when the inner length wall panels are folded over to the inside of outer length wall panels 1414 and 1416. Each of the stacking tabs has laterally extending wings that are captured between their respective inner and outer length wall panels.

Figure 16:
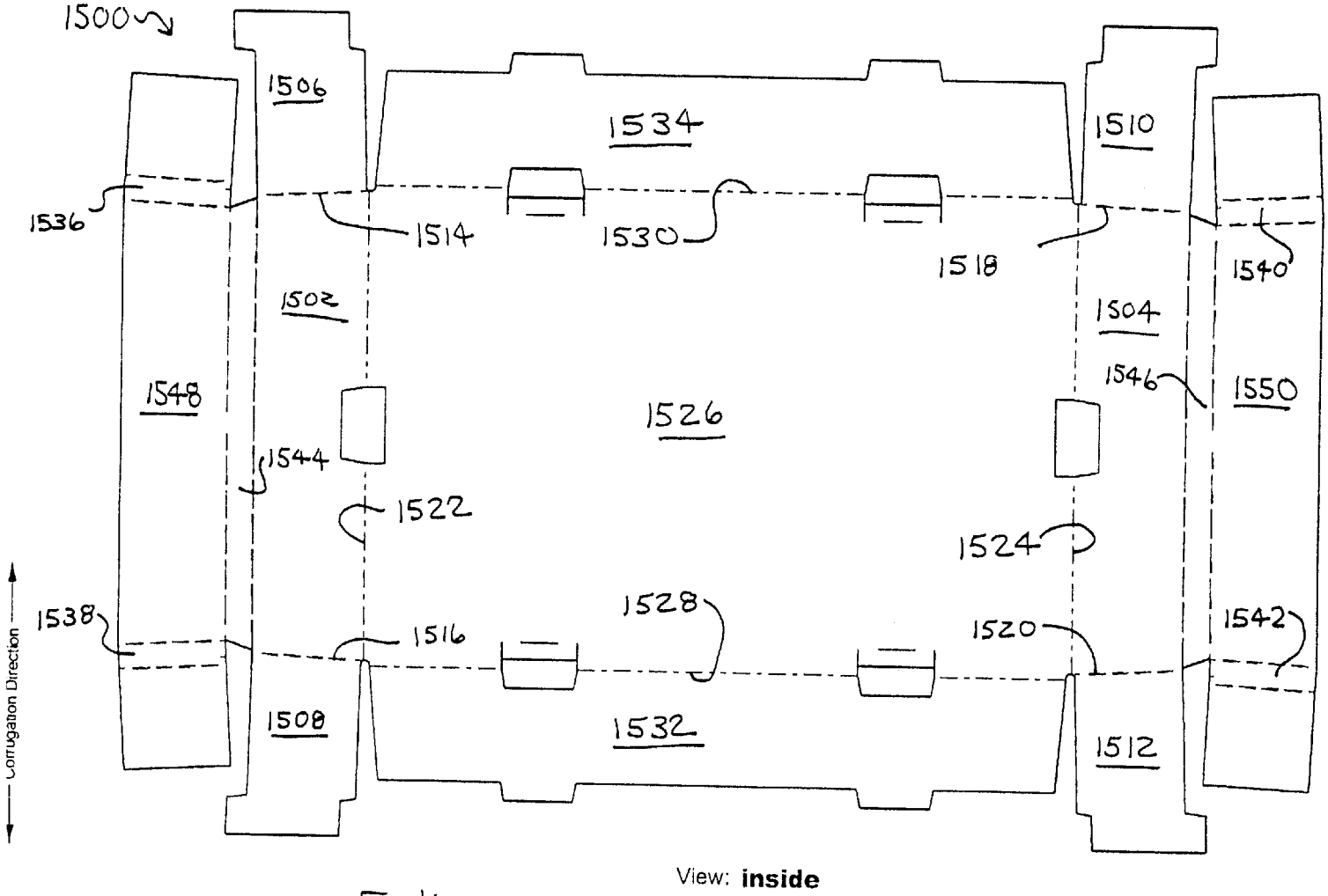
FIG. 16 is a plan view of another blank for another alternative embodiment of the present invention.

FIG. 16 illustrates a blank for another embodiment of the present invention. Aside from the triangular gusset panels (which do not extend completely to the bottom edges of their respective inner length wall panels, and which function in a manner similar to that of the previously-described embodiments), blank 1500 includes outer end wall panels 1502, 1504, with respective minor flaps 1506, 1508, 1510, 1510 and 1512. The fold lines 1514, 1516, 1518 and 1520, that separate minor flaps 1506, 1508, 1510 and 1512 from their respective outer end wall panels 1502, 1504 are oblique with respect to both the fold lines 1522, 1524 that separate the outer end wall panels 1502, 1504 from the bottom wall panel 1526, as well as the folds lines 1528, 1530, that separate the length wall panels 1532, 1534 from bottom wall panel 1526. Blank 1500 also includes substantially rectangular gusset panels 1536, 1538, 1540 and 1542, defined by fold lines that are oblique to each of fold lines 1522, 1524, 1528 and 1530. Blank 1500 also includes narrow transverse panels 1544, 1546 that separate outer end wall panels 1502, 1504 from their respective inner end wall panels 1548, 1550. Upon articulation of blank 1526, panels 1544, 1546 form shoulders at the ends of the tray, while inner end wall panels 1548, 1550 incline outwardly, from top to bottom, so that the free edges of inner end wall panels 1548, 1550, "point" toward fold lines 1522, 1524, respectively.

Figure 17:
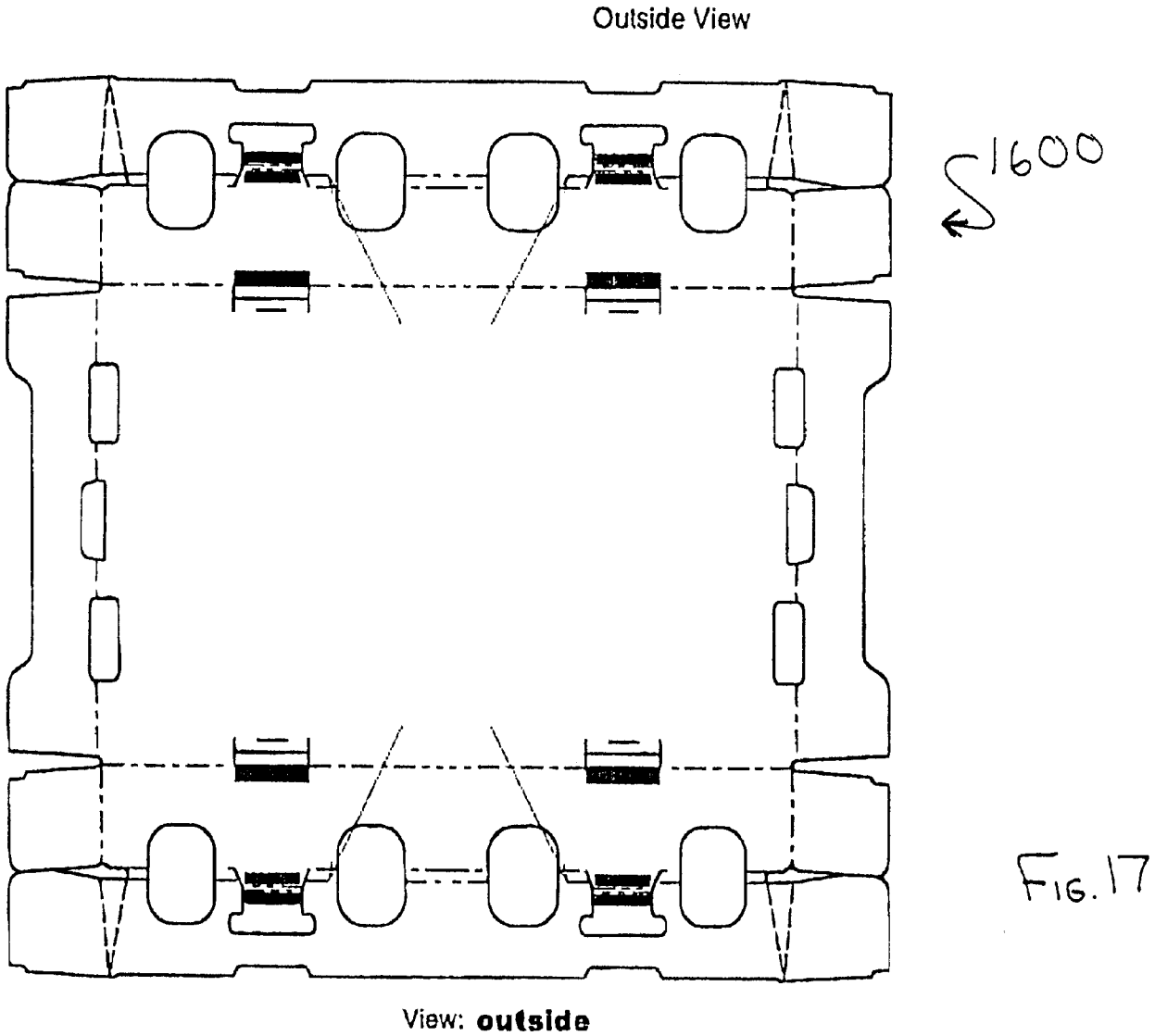
FIG. 17 is a plan view of another blank for another alternative embodiment of the present invention.
Figure 18:
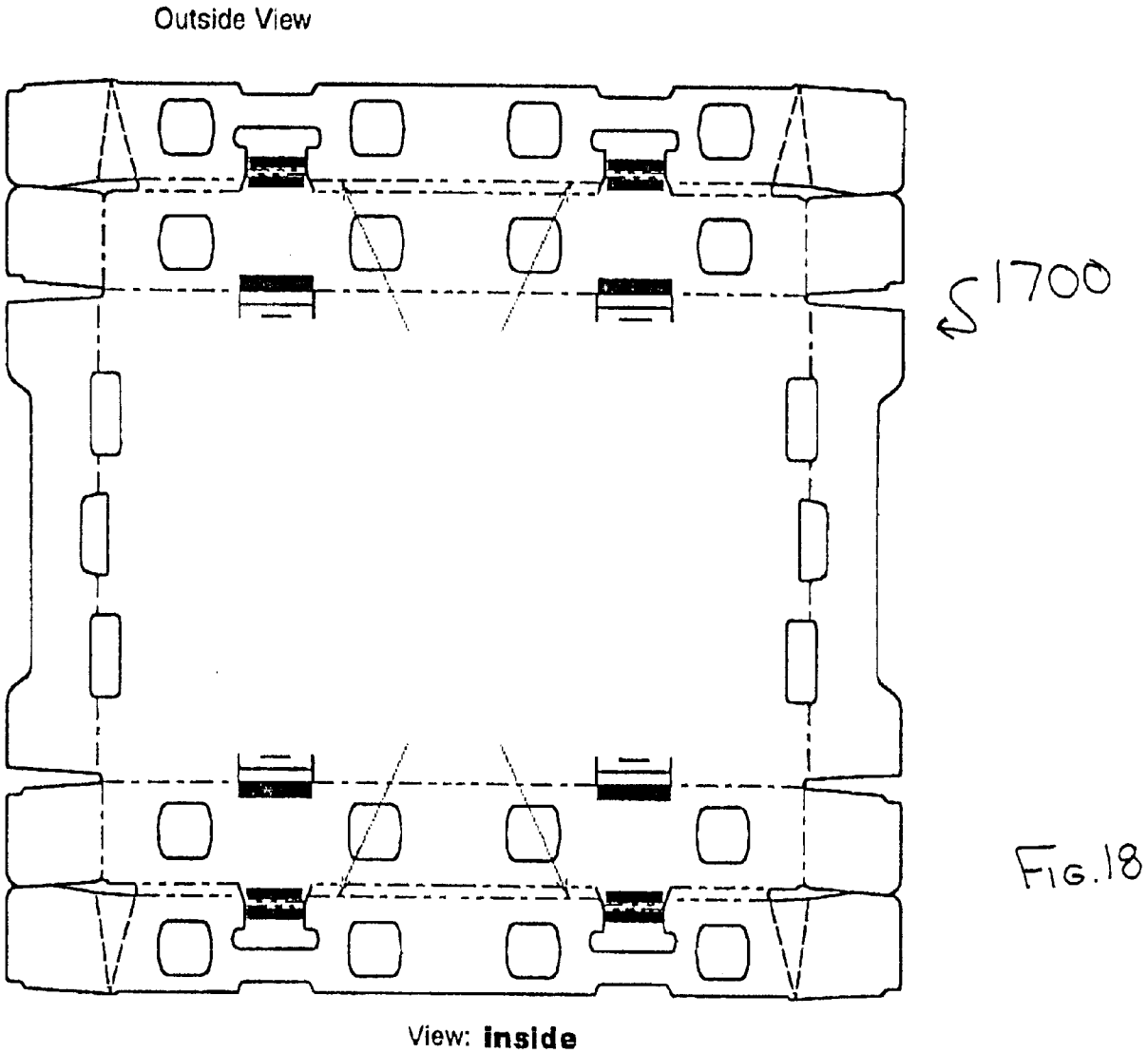
FIG. 18 is a plan view of still another blank for another alternative embodiment of the present invention.

FIG. 17 is a plan view of another blank 1600 for another alternative embodiment of the present invention, which is similar in structure and mode of operation to blank 1400 of FIG. 15. FIG. 18 is a plan view of still another blank 1700 for another alternative embodiment of the present invention, which is also similar in structure and mode of operation to blank 1400 of FIG. 15.

The folding gusset arrangement of the present invention allows the corners of the shipping container to have optimized support surface area, while consuming minimum amount of shipping container space and volume.

The present invention also permits greater flexibility in the use of standardized interior packaging. In many produce applications, inner packaging in the form of a molded pulp or molded plastic sheeting is used to provide separation between multiple pieces of product, such as fragile or easily bruised produce. This inner packaging, well known in the art, is generally standardized, in size and shape, placing limitations on the size of the stacking support corners used with the typical gusseted corner construction. The construction of the present invention places the base of the corner near or above the 90-degree connection of the adjacent side and short end walls, while the radiating "V" profile angles the gusset inwardly. This allows the use of standardized interior packaging, while providing the opportunity to have a larger surface bearing area. The advantage is that the construction of the corner can be customized for various size produce, while allowing the use of standardized, rather than customized, interior packaging.

While the present invention is disclosed in the embodiment of shipping containers having inclined sidewalls, the inclined diagonal gussets can be used with shipping containers having all vertical sidewalls, or in trays in which all sidewalls are inwardly inclined. This gusset structure can be used in shipping containers having both square and non-square footprints. The number and placement of the stacking tabs likewise may be varied by one of ordinary skill in the art having the present disclosure before them, without departing from the scope of the invention.

The use of inclined sidewalls presents special advantages with respect to the gusset construction of the present invention. Angled long or short sidewalls provide the opportunity for even greater container support for heavy products. Coupled with completely enclosed receiving slots, the angled sidewalls permit the stacking tab or tabs to be locked into place, with improved stability and stacking integrity.

For shipping containers of greater depth dimensions, the flap folding sequence of the present invention, that of (proceeding from the interior to the exterior of the container) minor, minor, major may also provide additional benefits. In (vertically) deep shipping container structures, the size of the single panel long or short sidewall may be significantly larger than the corresponding adjacent doubled short or long sidewall panels need to be. This results in increased trim during die cutting and more waste and cost for the customer. Reducing the height of the single panel long or short sidewall can reduce trim waste and cost, but may decrease its location with the height of the minor flaps.

Other prior art shipping container designs place the minor flaps on opposite sides of the single long or short sidewall, sandwiching it between the minor flaps. When the single panel long or short sidewall is reduced in height, this arrangement leaves either of these minor flaps exposed and unsupported by the other components. In the minor, minor, major flap arrangement of the present invention, the major panel can be reduced in height, without leaving the other two minor flaps (which provide much if not most of the stacking strength) unsupported.

The foregoing description and drawings merely explain and illustrate the invention, and the invention is not limited except insofar as the appended claims are so limited, as those skilled in the art who have the disclosure before them will be able to make modifications and variations therein without departing from the scope of the invention.

I claim:

1. A stackable shipping container formed from a blank, the blank comprising:

a substantially rectangular bottom wall having two perpendicularly arranged pairs of opposed side edge regions;

first and second pairs of opposed first sidewalls, emanating from the two perpendicularly arranged pairs of opposed side edge regions;

one pair of opposed second sidewalls, emanating from first edge regions of the first pair of opposed first sidewalls;

pairs of first minor flaps, emanating from second edge regions of each of the first pair of opposed first sidewalls;

pairs of second minor flaps, connected to third edge regions of each of the pair of opposed second sidewalls, nonrectangular gusset panels, disposed substantially between the second minor flaps and the respective adjacent end edge regions of the respective second sidewalls, the first and second pairs of opposed first sidewalls, the pair of opposed second sidewalls, and the pairs of first minor flaps and pairs of second minor flaps being operably configured, upon articulation, so that each of the second sidewalls is folded inwardly, in juxtaposed overlying relation to an inside surface of a respective one of the first pair of first sidewalls, each of the first minor flaps is in juxtaposed overlying relation to an inside surface of a respective adjacent one of the second pair of first sidewalls, and each of the second minor flaps is in juxtaposed overlying relation to an inside surface of a respective one of the first minor flaps;

the nonrectangular gusset panels being provided with a top region having a width that is greater than the width at a bottom region thereof, so that upon articulation of the blank, the nonrectangular gusset panels extend diagonally across corner regions of the stackable shipping container, with the top regions of the nonrectangular gusset panels extending farther inwardly into an interior region of the stackable shipping container than the bottom regions of the nonrectangular gusset panels.

2. The stackable shipping container according to claim 1, wherein one pair of first sidewalls is longer than the other pair of first sidewalls.

3. The stackable shipping container according to claim 1, wherein the first and second minor flaps have angled bottom edges so that upon articulation of the blank, at least the first pair of first side walls and the pair of second sidewalls are inwardly inclined with respect to the bottom wall.

4. The stackable shipping container according to claim 1, wherein the nonrectangular gusset panels are defined by pairs of fold lines disposed between the second minor flaps and the respective adjacent end edge regions of the respective second sidewalls, in which the fold lines have an acute angle subtended between them.

5. The stackable shipping container according to claim 4, wherein the fold lines defining the nonrectangular gusset panels do not intersect within the blank.

6. The stackable shipping container according to claim 4, wherein the fold lines defining the nonrectangular gusset panels intersect at the edge regions of the blank.

7. The stackable shipping container according to claim 4, wherein the fold lines defining the nonrectangular gusset panels intersect at positions inwardly removed from edge regions of the blank.

8. The stackable shipping container according to claim 1, further comprising:

one or more stacking tabs defined by cutout regions disposed between the first pair of opposed first sidewalls and respective ones of the pair of opposed second sidewalls; and one or more stacking tab receiving apertures disposed in the bottom wall.

9. The stackable shipping container according to claim 8, wherein the one or more stacking tabs of the stackable shipping container are configured to cooperate with and be insertingly received by the slots of a similar stackable shipping container stacked atop the stackable shipping container.

10. The stackable shipping container according to claim 3, wherein the first and second minor flaps emanate from the first pair of first side walls and the pair of second sidewalls, respectively, by inclined fold lines, so that upon articulation of the blank, the second pair of first sidewalls are also inwardly inclined with respect to the bottom wall.

11. A blank for a stackable shipping container, comprising:

a substantially rectangular bottom wall having two perpendicularly arranged pairs of opposed side edge regions;

first and second pairs of opposed first sidewalls, emanating from the two perpendicularly arranged pairs of opposed side edge regions;

one pair of opposed second sidewalls, emanating from first edge regions of the first pair of opposed first sidewalls;

pairs of first minor flaps, emanating from second edge regions of each of the first pair of opposed first sidewalls;

pairs of second minor flaps, connected to third edge regions of each of the pair of opposed second sidewalls, nonrectangular gusset panels, disposed substantially between the second minor flaps and the respective adjacent end edge regions of the respective second sidewalls, the first and second pairs of opposed first sidewalls, the pair of opposed second sidewalls, and the pairs of first minor flaps and pairs of second minor flaps being operably configured, upon articulation, so that each of the second sidewalls is folded inwardly, in juxtaposed overlying relation to an inside surface of a respective one of the first pair of first sidewalls, each of the first minor flaps is in juxtaposed overlying relation to an inside surface of a respective adjacent one of the second pair of first sidewalls, and each of the second minor flaps is in juxtaposed overlying relation to an inside surface of a respective one of the first minor flaps;

the nonrectangular gusset panels being provided with a top region having a width that is greater than the width at a bottom region thereof, so that upon articulation of the blank, the nonrectangular gusset panels extend diagonally across corner regions of the stackable shipping container, with the top regions of the nonrectangular gusset panels extending farther inwardly into an interior region of the stackable shipping container than the bottom regions of the nonrectangular gusset panels.

12. The blank according to claim 11, wherein one pair of first sidewalls is longer than the other pair of first sidewalls.

13. The blank according to claim 11, wherein the first and second minor flaps have angled bottom edges so that upon articulation of the blank, at least the first pair of first side walls and the pair of second sidewalls are inwardly inclined with respect to the bottom wall.

14. The blank according to claim 11, wherein the nonrectangular gusset panels are defined by pairs of fold lines disposed between the second minor flaps and the respective adjacent end edge regions of the respective second sidewalls, in which the fold lines have an acute angle subtended between them.

15. The blank according to claim 14, wherein the fold lines defining the nonrectangular gusset panels do not intersect within the blank.

16. The blank according to claim 14, wherein the fold lines defining the nonrectangular gusset panels intersect at the edge regions of the blank.

17. The blank according to claim 14, wherein the fold lines defining the nonrectangular gusset panels intersect at positions inwardly removed from edge regions of the blank.

18. The blank according to claim 11, further comprising:

one or more stacking tabs defined by cutout regions disposed between the first pair of opposed first sidewalls and respective ones of the pair of opposed second sidewalls; and one or more stacking tab receiving apertures disposed in the bottom wall.

19. The blank according to claim 18, wherein the one or more stacking tabs of the blank are configured, upon articulation of the blank into a shipping container, to cooperate with and be insertingly received by the slots of a similarly articulated similar blank stacked atop the articulated blank.

20. The blank according to claim 13, wherein the first and second minor flaps emanate from the first pair of first side walls and the pair of second sidewalls, respectively, by inclined fold lines, so that upon articulation of the blank, the second pair of first sidewalls are also inwardly inclined with respect to the bottom wall.

21. A stackable shipping container formed from a blank, the blank comprising:

a substantially rectangular bottom wall having two perpendicularly arranged pairs of opposed side edge regions;

first and second pairs of opposed first sidewalls, emanating from the two perpendicularly arranged pairs of opposed side edge regions;

one pair of opposed second sidewalls, emanating from first edge regions of the first pair of opposed first sidewalls;

pairs of first minor flaps, emanating from second edge regions of each of the first pair of opposed first sidewalls;

pairs of second minor flaps, connected to third edge regions of each of the pair of opposed second sidewalls, non-rectangular gusset panels, disposed substantially between the second minor flaps and the respective adjacent end edge regions of the respective second sidewalls, the first and second pairs of opposed first sidewalls, the pair of opposed second sidewalls, and the pairs of first minor flaps and pairs of second minor flaps being operably configured, upon articulation, so that each of the second sidewalls is folded inwardly, in juxtaposed overlying relation to an inside surface of a respective one of the first pair of first sidewalls, each of the first minor flaps is in juxtaposed overlying relation to an inside surface of a respective adjacent one of the second pair of first sidewalls, and each of the second minor flaps is in juxtaposed overlying relation to an inside surface of a respective one of the first minor flaps;

each of the non-rectangular gusset panels being defined by pairs of fold lines, each of which extend substantially obliquely with respect to fold lines separating the opposed first sidewalls from the bottom wall.

22. A stackable shipping container formed from a blank, the blank comprising:

a substantially rectangular bottom wall having two perpendicularly arranged pairs of opposed side edge regions;

first and second pairs of opposed first sidewalls, emanating from the two perpendicularly arranged pairs of opposed side edge regions;

one pair of opposed second sidewalls, emanating from first edge regions of the first pair of opposed first sidewalls;

pairs of first minor flaps, emanating from second edge regions of each of the first pair of opposed first sidewalls;

pairs of second minor flaps, connected to third edge regions of each of the pair of opposed second sidewalls, rectangular gusset panels, disposed substantially between the second minor flaps and the respective adjacent end edge regions of the respective second sidewalls, the first and second pairs of opposed first sidewalls, the pair of opposed second sidewalls, and the pairs of first minor flaps and pairs of second minor flaps being operably configured, upon articulation, so that each of the second sidewalls is folded inwardly, in juxtaposed overlying relation to an inside surface of a respective one of the first pair of first sidewalls, each of the first minor flaps is in juxtaposed overlying relation to an inside surface of a respective adjacent one of the second pair of first sidewalls, and each of the second minor flaps is in juxtaposed overlying relation to an inside surface of a respective one of the first minor flaps;

each of the rectangular gusset panels being defined by pairs of fold lines, each of which extend substantially obliquely with respect to fold lines separating the opposed first sidewalls from the bottom wall.

* * * * *